US009353958B2

(12) United States Patent
Motomura et al.

(10) Patent No.: US 9,353,958 B2
(45) Date of Patent: May 31, 2016

(54) AIR-CONDITIONING APPARATUS

(75) Inventors: Yuji Motomura, Chiyoda-ku (JP); Koji Yamashita, Chiyoda-ku (JP); Hiroyuki Morimoto, Chiyoda-ku (JP); Jyunichi Ue, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 816 days.

(21) Appl. No.: 13/577,762

(22) PCT Filed: Feb. 10, 2010

(86) PCT No.: PCT/JP2010/000809

§ 371 (c)(1),
(2), (4) Date: Aug. 8, 2012

(87) PCT Pub. No.: WO2011/099054

PCT Pub. Date: Aug. 18, 2011

(65) Prior Publication Data

US 2012/0304675 A1 Dec. 6, 2012

(51) Int. Cl.
*F25D 21/06* (2006.01)
*F24F 3/06* (2006.01)
(Continued)

(52) U.S. Cl.
CPC . *F24F 3/06* (2013.01); *F24F 11/02* (2013.01); *F25B 13/00* (2013.01); *F25B 25/005* (2013.01);
(Continued)

(58) Field of Classification Search
CPC ..... F25B 13/00; F25B 7/00; F25B 25/00; F25B 30/02; F25B 30/00
USPC ..... 62/159, 175, 185, 180
See application file for complete search history.

(56) References Cited

U.S. PATENT DOCUMENTS 2,202,946 A * 6/1940 Carrier ..... 165/299
2,279,657 A * 4/1942 Crawford ..... 62/157
(Continued)

FOREIGN PATENT DOCUMENTS

JP 2-037265 A 2/1990
JP 2-078869 A 3/1990
(Continued)

OTHER PUBLICATIONS

Office Action issued on Dec. 29, 2014, by the Chinese Patent Office in corresponding Chinese Patent Application No. 201080063512.2 and an English translation of the Office Action. (14 pages).
(Continued)

*Primary Examiner* — Ljiljana Ciric
*Assistant Examiner* — Alexis Cox
(74) *Attorney, Agent, or Firm* — Buchanan Ingersoll & Rooney PC

(57) ABSTRACT

An apparatus including a refrigerant circuit having a compressor, a heat source side heat exchanger and two or more heat exchangers related to heat medium. A heat medium circuit includes two heat medium loops each including a pump. A bypass piping is provided at the refrigerant circuit for bypassing the heart exchanger related to heat medium. A controller is configured to perform a defrosting operation, a heating operation, a heat recovery defrosting operation mode, and a bypass defrosting operation that melts frost attached to the heat source side heat exchanger during the heating operation mode by passing a portion or all of the heat source side refrigerant through the bypass piping.

10 Claims, 8 Drawing Sheets

(51) Int. Cl.

| | |
|---|---|
| ***F24F 11/02*** | (2006.01) |
| ***F25B 13/00*** | (2006.01) |
| ***F25B 25/00*** | (2006.01) |
| ***F25B 47/02*** | (2006.01) |
| *F24F 11/00* | (2006.01) |

(52) U.S. Cl.
CPC ..... *F25B 47/025* (2013.01); *F24F 2011/0087* (2013.01); *F24F 2221/54* (2013.01); *F25B 2313/0272* (2013.01); *F25B 2313/02322* (2013.01); *F25B 2313/02732* (2013.01); *F25B 2313/02741* (2013.01); *F25B 2600/2513* (2013.01)

(56) References Cited

U.S. PATENT DOCUMENTS

| | | | | | |
|---|---|---|---|---|---|
| 2,315,379 | A | * | 3/1943 | Robson | 62/95 |
| 2,490,983 | A | * | 12/1949 | Smith et al. | 62/185 |
| 2,797,068 | A | * | 6/1957 | McFarlan | 165/207 |
| 3,520,146 | A | * | 7/1970 | Arnold, Sr. | 62/115 |
| 3,527,059 | A | * | 9/1970 | Rust et al. | 62/115 |
| 3,670,806 | A | * | 6/1972 | McFarlan | 165/210 |
| 4,210,957 | A | * | 7/1980 | Spethmann | 700/276 |
| 4,393,662 | A | * | 7/1983 | Dirth | 62/115 |
| 4,463,574 | A | * | 8/1984 | Spethmann et al. | 62/175 |
| 4,817,395 | A | * | 4/1989 | Martinez, Jr. | 62/175 |
| 6,298,683 | B1 | * | 10/2001 | Kondo et al. | 62/335 |
| 6,393,858 | B1 | * | 5/2002 | Mezaki et al. | 62/335 |
| 2006/0032623 | A1 | * | 2/2006 | Tsubone et al. | 165/202 |

FOREIGN PATENT DOCUMENTS

| | | | | |
|---|---|---|---|---|
| JP | 5-280818 | A | | 10/1993 |
| JP | 2001-289465 | A | | 10/2001 |
| JP | 2003-172523 | A | | 6/2003 |
| JP | 2003-302131 | A | | 10/2003 |
| JP | 2003-343936 | A | | 12/2003 |
| JP | 2005-140444 | A | | 6/2005 |
| JP | 3702855 | B2 | | 10/2005 |
| JP | 2006-46692 | A | | 2/2006 |
| JP | 2006-112781 | A | | 4/2006 |
| JP | 2008-082653 | A | | 4/2008 |
| JP | 2008-134045 | A | | 6/2008 |
| JP | 2009-058175 | A | | 3/2009 |
| WO | WO 9420800 | A1 | * | 9/1994 |
| WO | WO 2009/122477 | A1 | | 10/2009 |
| WO | WO 2009133640 | A1 | * | 11/2009 |

OTHER PUBLICATIONS

International Search Report (PCT/ISA/210) issued on May 18, 2010, by the Japanese Patent Office as the International Searching Authority for International Application No. PCT/JP2010/000809.

Office Action (Notice of Reasons for Rejection) dated Jun. 4, 2013, issued in corresponding Japanese Patent Application No. 2011-553612, and an English Translation thereof. (7 pages).

* cited by examiner

AIR-CONDITIONING APPARATUS

TECHNICAL FIELD

The present invention relates to an air-conditioning apparatus that is applied to, for example, a multi-air-conditioning apparatus for a building.

BACKGROUND ART

In conventional air-conditioning apparatuses such as a multi-air-conditioning apparatus for a building, a refrigerant is circulated between an outdoor unit, which is a heat source unit disposed, for example, outside a structure, and indoor units disposed in rooms in the structure. The refrigerant transfers heat or removes heat to heat or cool air, thus heating or cooling an air conditioned space through the heated or cooled air. Hydrofluorocarbon (HFC) based refrigerants are often used as the refrigerant, for example. An air-conditioning apparatus using a natural refrigerant, such as carbon dioxide ($CO_2$), has also been proposed.

Furthermore, in an air-conditioning apparatus called a chiller, cooling energy or heating energy is generated in a heat source unit disposed outside a structure. Water, antifreeze, or the like is heated or cooled by a heat exchanger disposed in an outdoor unit and it is carried to an indoor unit, such as a fan coil unit or a panel heater, to perform heating or cooling (refer to Patent Literature 1, for example).

Moreover, there is an air-conditioning apparatus called a heat recovery chiller that connects a heat source unit to each indoor unit with four water pipings arranged therebetween, supplies cooled and heated water or the like simultaneously, and allows the cooling and heating in the indoor units to be selected freely (refer to Patent Literature 2, for example).

In addition, there is an air-conditioning apparatus that disposes a heat exchanger for a primary refrigerant and a secondary refrigerant near each indoor unit in which the secondary refrigerant is carried to the indoor unit (refer to Patent Literature 3, for example).

Furthermore, there is an air-conditioning apparatus that connects an outdoor unit to each branch unit including a heat exchanger with two piping in which a secondary refrigerant is carried to an indoor unit (refer to Patent Literature 4, for example).

CITATION LIST

Patent Literature

Patent Literature 1: Japanese Unexamined Patent Application Publication No. 2005-140444 (p. 4, FIG. 1, for example)

Patent Literature 2: Japanese Unexamined Patent Application Publication No. 5-280818 (pp. 4 and 5, FIG. 1, for example)

Patent Literature 3: Japanese Unexamined Patent Application Publication No. 2001-289465 (pp. 5 to 8, FIG. 1, FIG. 2, for example)

Patent Literature 4: Japanese Unexamined Patent Application Publication No. 2003-343936 (p. 5, FIG. 1)

SUMMARY OF INVENTION

Technical Problem

In an air-conditioning apparatus of the related art, such as a multi-air-conditioning apparatus for a building, there is a possibility of a refrigerant leakage to, for example, an indoor space since the refrigerant is circulated to an indoor unit. On the other hand, in the air-conditioning apparatus disclosed in Patent Literature 1 and Patent Literature 2, the refrigerant does not pass through the indoor unit. However, in the air-conditioning apparatus disclosed in Patent Literature 1 and Patent Literature 2, the heat medium needs to be heated or cooled in a heat source unit disposed outside a structure, and needs to be carried to the indoor unit side. Accordingly, a circulation path of the heat medium becomes long. In this case, carrying of heat for a predetermined heating or cooling work using the heat medium consumes more amount of energy, in the form of conveyance power and the like, than the amount of energy consumed by the refrigerant. Accordingly, as the circulation path becomes long, the conveyance power becomes markedly large. This indicates that energy saving can be achieved in an air-conditioning apparatus if the circulation of the heat medium can be controlled appropriately.

In the air-conditioning apparatus disclosed in Patent Literature 2, the four piping connecting the outdoor side and the indoor space need to be arranged in order to allow cooling or heating to be selectable in each indoor unit. Disadvantageously, there is little ease of construction. In the air-conditioning apparatus disclosed in Patent Literature 3, secondary medium circulating means such as a pump needs to be provided to each indoor unit. Disadvantageously, the system is not only costly but also creates a large noise, and is not practical. In addition, since the heat exchanger is disposed near each indoor unit, the risk of a refrigerant leakage to a place near the indoor space cannot be eliminated.

In the air-conditioning apparatus disclosed in Patent Literature 4, a primary refrigerant that has exchanged heat flows into the same passage as that of the primary refrigerant before heat exchange. Accordingly, when a plurality of indoor units is connected, it is difficult for each indoor unit to exhibit its maximum capacity. Such a configuration wastes energy. Furthermore, each branch unit are connected to an extension piping with a total of four piping, two for cooling and two for heating. This configuration is consequently similar to that of a system in which the outdoor unit is connected to each branching unit with four piping. Accordingly, there is little ease of construction in such a system.

Additionally, in an air-conditioning apparatus of the related art such as a multi-air-conditioning apparatus for a building, there is one that is provided with a defrosting operation mode to remove frost attached to a heat source side heat exchanger. However, in the defrosting operation mode of such an air-conditioning apparatus, since the defrosting is carried out by providing the heat source side heat exchanger with merely a heat capacity that had been retained in a refrigerant that had been conveyed to an indoor unit performing a heating operation and a heat capacity that had been retained in an actuator in a refrigerant conveying passage, it takes a long time until the defrosting is completed. Moreover, during the above, since the heating operation in the indoor space is suspended, the temperature of the indoor air is lowered, thus, disadvantageously undermining performance of a comfortable heating operation.

The present invention has been made to overcome the above-described disadvantages and provides an air-conditioning apparatus capable of achieving energy saving. The invention further provides an air-conditioning apparatus capable of achieving improvement of safety by not allowing refrigerant to circulate in or near an indoor unit. The invention further provides an air-conditioning apparatus that is capable of reducing the number of piping connecting an outdoor unit to a branch unit (heat medium relay unit) or the branch unit to an indoor unit, and improving ease of construction as well as allowing efficient defrosting operation to be performed, thus improving energy efficiency.

Solution to Problem

An air-conditioning apparatus according to the invention includes a refrigerant circuit including at least a compressor, a heat source side heat exchanger, an expansion device, and a refrigerant side passage of a heat exchanger related to heat medium connected by piping in series, the refrigerant circuit circulating a heat source side refrigerant; and a heat medium circuit including at least a heat medium side passage of the heat exchanger related to heat medium, a pump, and a use side heat exchanger connected by piping in series, the heat medium circuit circulating a heat medium, in which at least two or more pumps and at least two or more heat exchangers related to heat medium are provided, and at least a bypass piping is provided in the refrigerant circuit, bypasses the heat exchanger related to heat medium and returns the heat source side refrigerant to the compressor. The air-conditioning apparatus has: a heating operation mode in which at least one of the heat exchangers related to heat medium heats the heat medium, a heat recovery defrosting operation mode in which frost attached to the heat source side heat exchanger is melt by driving at least one of the pumps and by having the heat source side refrigerant receive heat from the heat medium flowing in at least one of the heat exchangers related to heat medium during the heating operation mode; and a bypass defrosting operation mode in that frost attached to the heat source side heat exchanger is melt by passing a portion or all of the heat source side refrigerant through the bypass piping during the heating operation mode.

Advantageous Effects of Invention

According to the air-conditioning apparatus of the invention, the piping in which the heat medium circulates can be shortened and small conveyance power is required, and thus, safety is increased and energy is saved. Further, according to the air-conditioning apparatus of the invention, efficient defrosting operation can be carried out and further energy saving can be achieved.

DESCRIPTION OF EMBODIMENTS

Embodiment of the present invention will be described below with reference to the drawings.

Figure 1:
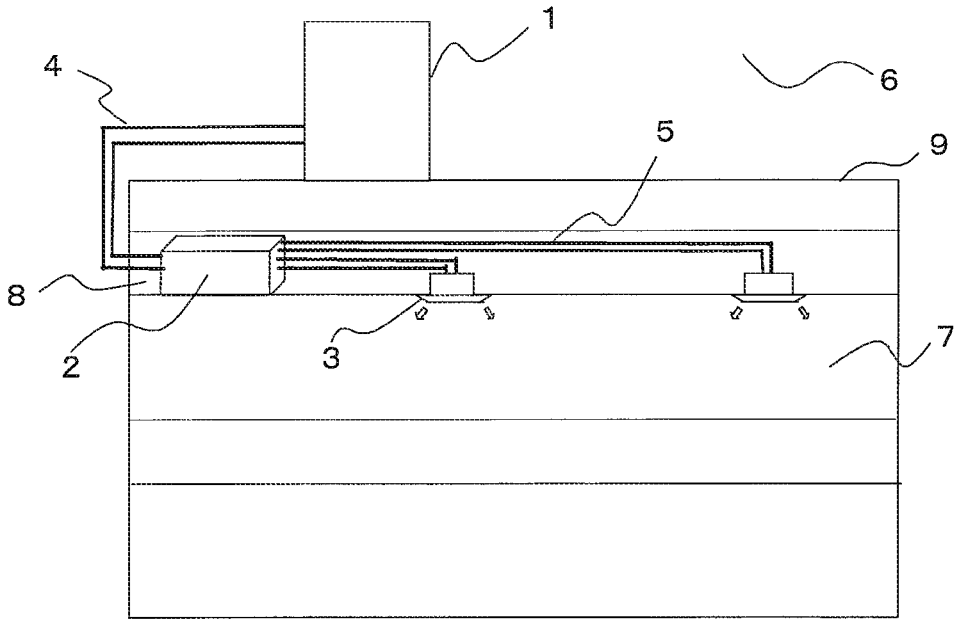
FIG. 1 is a schematic diagram illustrating an exemplary installation of an air-conditioning apparatus according to Embodiment of the invention.

FIG. 1 is a schematic diagram illustrating an exemplary installation of an air-conditioning apparatus according to Embodiment of the invention. The exemplary installation of the air-conditioning apparatus will be described with reference to FIG. 1. This air-conditioning apparatus uses refrigeration cycles (a refrigerant circuit A and a heat medium circuit B) in which refrigerants (a heat source side refrigerant and a heat medium) circulate such that a cooling mode or a heating mode can be freely selected as its operation mode in each indoor unit. It should be noted that the dimensional relationships of components in FIG. 1 and other subsequent figures may be different from the actual ones.

Referring to FIG. 1, the air-conditioning apparatus according to Embodiment includes a single outdoor unit 1, functioning as a heat source unit, a plurality of indoor units 3, and a relay unit 2 disposed between the outdoor unit 1 and the indoor units 3. The relay unit 2 exchanges heat between the heat source side refrigerant and the heat medium. The outdoor unit 1 and the relay unit 2 are connected with refrigerant piping 4 through which the heat source side refrigerant flows. The relay unit 2 and each indoor unit 3 are connected with piping 5 (heat medium piping) through which the heat medium flows. Cooling energy or heating energy generated in the outdoor unit 1 is delivered through the relay unit 2 to the indoor units 3.

The outdoor unit 1 is typically disposed in an outdoor space 6 that is a space (e.g., a roof) outside a structure 9, such as a building, and is configured to supply cooling energy or heating energy through the relay unit 2 to the indoor units 3. Each indoor unit 3 is disposed at a position that can supply cooling air or heating air to an indoor space 7, which is a space (e.g., a living room) inside the structure 9, and supplies air for cooling or air for heating to the indoor space 7 that is an air conditioned space. The relay unit 2 is configured so that it can be disposed in a space different from the outdoor space 6 and the indoor space 7, (for example, a common space or a space above a ceiling in the structure 9, hereinafter, simply referred to as a "space 8"). The relay unit 2 is connected to the outdoor unit 1 and the indoor units 3 with refrigerant piping 4 and piping 5, respectively, and conveys cooling energy or heating energy supplied from the outdoor unit 1 to the indoor units 3.

As illustrated in FIG. 1, in the air-conditioning apparatus according to Embodiment 1, the outdoor unit 1 is connected to the relay unit 2 using two refrigerant piping 4, and the relay unit 2 is connected to each indoor unit 3 using two piping 5. As described above, in the air-conditioning apparatus according to Embodiment, each of the units (the outdoor unit 1, the indoor units 3, and the relay unit 2) is connected using two piping (the refrigerant piping 4 or the piping 5), thus construction is facilitated.

An operation of the air-conditioning apparatus according to Embodiment will be briefly described.

The heat source side refrigerant is conveyed from the outdoor unit 1 to the relay unit 2 through the refrigerant piping 4. The heat source side refrigerant that has been conveyed to the relay unit 2 exchanges heat with the heat medium in a heat exchanger related to heat medium (described subsequently) in the relay unit 2 and transfers the heating energy or the cooling energy to the heat medium. In the relay unit 2, the heating energy or the cooling energy stored in the heat medium is conveyed with a pump (described subsequently) to the indoor units 3 through the piping 5. The heat medium that has been conveyed to the indoor units 3 is used in the heating operation or the cooling operation for the indoor space 7.

Note that in FIG. 1, an exemplary state in which the relay unit 2 is disposed in the space 8, which is in the structure 9 but is a separate space to the indoor space 7, as a different casing from the outdoor unit 1 and the indoor units 3 is illustrated. The relay unit 2 can be disposed in other spaces, such as a common space where an elevator or the like is installed. In addition, although FIG. 1 illustrates a case in which the indoor units 3 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIG. 1 illustrates a case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the used outdoor unit 1 is of a water-cooled type. Even when the outdoor unit 1 is disposed in such a place, no problem in particular will occur.

Furthermore, the relay unit 2 can be disposed near the outdoor unit 1. However, it should be noted that when the distance from the relay unit 2 to the indoor unit 3 is excessively long, because power for conveying the heat medium is significantly large, the advantageous effect of energy saving is reduced. Additionally, the numbers of connected outdoor unit 1, indoor units 3, and relay unit 2 are not limited to those illustrated in FIG. 1. The numbers thereof can be determined in accordance with the structure 9 where the air-conditioning apparatus according to Embodiment is installed.

Additionally, it is possible to connect a plurality of relay units 2 to a single outdoor unit 1, and by disposing the plurality of relay units 2 so as to be dotted throughout the space 8, it will be possible to cover the transfer of the heating energy or the cooling energy with the heat source side heat exchanger mounted in each relay unit 2. Configured as above, it will be possible to dispose an indoor unit 3 that is within the allowable limit of conveyance distance or height of the pump mounted in each relay unit 2, and thus will allow disposition of indoor units 3 to the entire structure 9.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used. While a heat exchanger related to heat medium 25*a* or a heat exchanger related to heat medium 25*b* is operating for heating, a refrigerant that typically changes between two phases is condensed and liquefied and a refrigerant that turns into a supercritical state, such as $CO_2$, is cooled in the supercritical state. As for the rest, either of the refrigerant acts in the same manner and offers the same advantages.

As regards the heat medium, for example, brine (antifreeze), water, a mixed solution of brine and water, or a mixed solution of water and an additive with high anticorrosive effect can be used. In the air-conditioning apparatus according to Embodiment, therefore, even if the heat medium leaks into the indoor space 7 through the indoor unit 3, because the heat medium used is highly safe, contribution to improvement of safety can be made.

Figure 2:
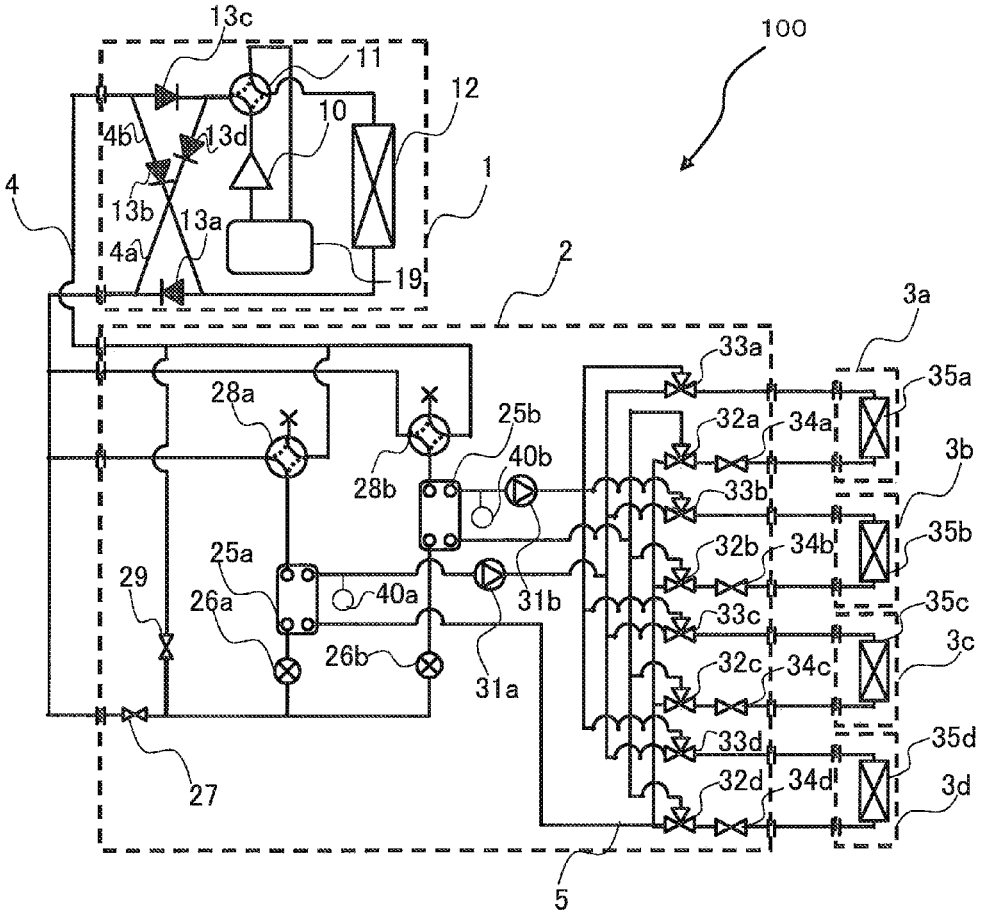
FIG. 2 is a schematic circuit diagram illustrating an exemplary circuit configuration of the air-conditioning apparatus according to Embodiment of the invention.

FIG. 2 is a schematic circuit diagram illustrating an exemplary circuit configuration of the air-conditioning apparatus (hereinafter, referred to as an "air-conditioning apparatus 100") according to Embodiment of the invention. The detailed circuit configuration of the air-conditioning apparatus 100 will be described with reference to FIG. 2. As illustrated in FIG. 2, the outdoor unit 1 and the relay unit 2 are connected with the refrigerant piping 4 through heat exchangers related to heat medium 25*a* and 25*b* included in the relay unit 2. Furthermore, the relay unit 2 and the indoor units 3 are connected with the piping 5 through the heat exchangers related to heat medium 25*a* and 25*b*. Note that the refrigerant piping 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19 mounted in its housing, which are connected in series with the refrigerant piping 4. The outdoor unit 1 further includes a first connecting piping 4*a*, a second connecting piping 4*b*, a check valve 13*a*, a check valve 13*d*, a check valve 13*b*, and a check valve 13*c*. By providing the first connecting piping 4*a*, the second connecting piping 4*b*, the check valve 13*a*, the check valve 13*d*, the check valve 13*b*, and the check valve 13*c*, the heat source side refrigerant can be made to flow into the relay unit 2 in a constant direction irrespective of the operation requested by the indoor units 3.

The compressor 10 sucks in the heat source side refrigerant, compress the heat source side refrigerant to a high-temperature high-pressure state, and conveys the refrigerant to the refrigerant circuit A. The compressor 10 may include, for example, a capacity-controllable inverter compressor. The first refrigerant flow switching device 11 switches the flow of the heat source side refrigerant between a heating operation mode (a heating only operation mode and a heating main operation mode) and a cooling operation mode (a cooling only operation mode and a cooling main operation mode).

The heat source side heat exchanger 12 functions as an evaporator in the heating operation, functions as a condenser (or a radiator) in the cooling operation, exchanges heat between air supplied from the air-sending device, such as a fan (not illustrated), and the heat source side refrigerant, and evaporates and gasifies or condenses and liquefies the heat source side refrigerant. The accumulator 19 is provided on the suction side of the compressor 10 and retains excessive refrigerant due to a difference in the heating operation and the cooling operation or excessive refrigerant due to a transitional operation change.

The check valve 13*a* is provided in the refrigerant piping 4 between the heat source side heat exchanger 12 and the relay unit 2 and permits the heat source side refrigerant to flow only in a predetermined direction (the direction from the outdoor unit 1 to the relay unit 2). The check valve 13*c* is provided in the refrigerant piping 4 between the relay unit 2 and the first refrigerant flow switching device 11 and permits the heat source side refrigerant to flow only in a predetermined direction (the direction from the relay unit 2 to the outdoor unit 1). The check valve 13*d* is provided in the first connecting piping 4*a* and allows the heat source side refrigerant discharged from the compressor 10 to flow through the relay unit 2 during the heating operation. The check valve 13*b* is disposed in the second connecting piping 4*b* and allows the heat source side refrigerant, returning from the relay unit 2 to flow to the suction side of the compressor 10 during the heating operation.

The first connecting piping 4*a* connects the refrigerant piping 4, between the first refrigerant flow switching device 11 and the check valve 13*c*, to the refrigerant piping 4, between the check valve 13*a* and the relay unit 2, in the outdoor unit 1. The second connecting piping 4*b* is configured to connect the refrigerant piping 4, between the check valve 13*c* and the relay unit 2, to the refrigerant piping 4, between the heat source side heat exchanger 12 and the check valve 13*a*, in the outdoor unit 1. It should be noted that FIG. 2 illustrates a case in which the first connecting piping 4*a*, the second connecting piping 4*b*, the check valve 13*a*, the check valve 13*d*, the check valve 13*b*, and the check valve 13*c* are disposed, but the device is not limited to this case, and they do not necessarily have to be provided.

[Indoor Units 3]

Each of the indoor units 3 include a use side heat exchanger 35 mounted in its housing. Each of the use side heat exchanger 35 is connected to a heat medium flow control device 34 and a second heat medium flow switching device 33 in the relay unit 2 with the piping 5. Each of the use side heat exchangers 35 exchanges heat between air supplied from an air-sending device, such as a fan, (not illustrated) and the heat medium in order to generate air for heating or air for cooling supplied to the indoor space 7.

FIG. 2 illustrates a case in which four indoor units 3 are connected to the relay unit 2. Illustrated are, from the top of the drawing, an indoor unit 3*a*, an indoor unit 3*b*, an indoor unit 3*c*, and an indoor unit 3*d*. In addition, the use side heat exchangers 35 are illustrated as, from the top of the drawing, a use side heat exchanger 35*a*, a use side heat exchanger 35*b*, a use side heat exchanger 35*c*, and a use side heat exchanger 35*d* each corresponding to the indoor units 3*a* to 3*d*. As is the case of FIG. 1, the number of connected indoor units 3 illustrated in FIG. 2 is not limited to four.

[Relay Unit 2]

The relay unit 2 includes in its housing at least two heat exchangers related to heat medium (refrigerant-to-water heat exchangers) 25, two expansion devices 26, an on-off device 27, an on-off device 29, two second refrigerant flow switching devices 28, two pumps 31, four first heat medium flow switching devices 32, the four second heat medium flow switching devices 33, and the four heat medium flow control devices 34.

Each of the two heat exchangers related to heat medium (heat exchanger related to heat medium 25*a* and heat exchanger related to heat medium 25*b*) functions as a condenser (radiator) when supplying the heat medium to an indoor unit 3 that is in heating operation and functions as an evaporator when supplying the heat medium to an indoor unit 3 that is in cooling operation, exchanges heat between the heat source side refrigerant and the heat medium, and conveys the cooling energy or heating energy that has been generated in the outdoor unit 1 and that is stored in the heat source side refrigerant to the heat medium.

The heat exchanger related to heat medium 25*a* is disposed between an expansion device 26*a* and a second refrigerant flow switching device 28*a* in the refrigerant circuit A and is used to cool the heat medium in the cooling only operation mode and the cooling and heating mixed operation mode and is used to heat the heat medium in the heating only operation mode. The heat exchanger related to heat medium 25*b* is disposed between an expansion device 26*b* and a second refrigerant flow switching device 28*b* in the refrigerant circuit A and is used to heat the heat medium in the heating only operation mode and the cooling and heating mixed operation mode and is used to cool the heat medium in the cooling only operation mode.

The two expansion devices 26 (the expansion device 26*a* and the expansion device 26*b*) each have functions of a reducing valve and an expansion valve and are configured to reduce the pressure of and expand the heat source side refrigerant. The expansion device 26*a* is disposed upstream of the heat exchanger related to heat medium 25*a*, upstream regarding the heat source side refrigerant flow during the cooling operation. The expansion device 26*b* is disposed upstream of the heat exchanger related to heat medium 25*b*, upstream regarding the heat source side refrigerant flow during the cooling operation. Each of the two expansion devices 26 may include a component having a variably controllable opening degree, such as an electronic expansion valve.

The on-off devices 27 and 29 each include, for example, a solenoid valve that is capable of performing opening and closing operation upon energization, and its opening and closing is controlled according to the operation mode of the indoor units 3 and the refrigerant passages of the refrigerant circuit A are switched. The on-off device 27 is disposed in the refrigerant piping 4 on the inlet side of the heat source side refrigerant. The on-off device 29 is disposed in a piping (bypass piping) connecting the refrigerant piping 4 on the inlet side of the heat source side refrigerant and the refrigerant piping 4 on an outlet side thereof.

The two second refrigerant flow switching devices 28 (second refrigerant flow switching device 28*a* and second refrigerant flow switching device 28*b*) each include, for example, a four-way valve, and switches the flow of the heat source side refrigerant so as to allow the corresponding heat exchanger related to heat medium 25 to be used as a condenser or an evaporator according to the operation mode of the indoor units 3. The second refrigerant flow switching device 28*a* is disposed downstream of the heat exchanger related to heat medium 25*a*, downstream regarding the heat source side refrigerant flow during the cooling operation. The second refrigerant flow switching device 28*b* is disposed downstream of the heat exchanger related to heat medium 25*b*, downstream regarding the heat source side refrigerant flow during the cooling only operation mode.

The two pumps 31 (a pump 31*a* and a pump 31*b*) each convey the heat medium flowing though the piping 5 to the indoor units 3. The pump 31*a* is disposed in the piping 5 between the heat exchanger related to heat medium 25*a* and the second heat medium flow switching devices 33. The pump 31*b* is disposed in the piping 5 between the heat exchanger related to heat medium 25*b* and the second heat medium flow switching devices 33. The two pumps 31 each include, for example, a capacity-controllable pump and may be one capable of controlling the flow rate according to the load in the indoor units 3.

The four first heat medium flow switching devices 32 (first heat medium flow switching devices 32*a* to 32*d*) each include, for example, a three-way valve and switch passages of the heat medium. Each first heat medium flow switching device 32 is disposed on an outlet side of a heat medium passage of the corresponding use side heat exchanger 35 such that one of the three ways is connected to the heat exchanger related to heat medium 25*a*, another one of the three ways is connected to the heat exchanger related to heat medium 25*b*, and the other one of the three ways is connected to the corresponding heat medium flow control device 34. That is, each first heat medium flow switching device 32 switches the passages of the heat medium that is to flow into the corresponding indoor unit 3 between the heat exchanger related to heat medium 25*a* and the heat exchanger related to heat medium 25*b*.

Note that the first heat medium flow switching devices 32 are arranged so that the number thereof (four in this case) corresponds to the installed number of indoor units 3. Illustrated from the top of the drawing are the first heat medium flow switching device 32*a*, the first heat medium flow switching device 32*b*, the first heat medium flow switching device 32*c*, and the first heat medium flow switching device 32*d*, so as to correspond to the respective indoor units 3. Further, regarding the switching of the heat medium passage, not only a complete switching from one to the other but a partial switching from one to the other is also included.

The four second heat medium flow switching devices 33 (second heat medium flow switching devices 33*a* to 33*d*) each include, for example, a three-way valve and are configured to switch passages of the heat medium. Each second heat medium flow switching device 33 is disposed on an inlet side of the heat medium passage of the corresponding use side heat exchanger 35 such that one of the three ways is connected to the heat exchanger related to heat medium 25*a*, another one of the three ways is connected to the heat exchanger related to heat medium 25*b*, and the other one of the three ways is connected to the corresponding use side heat exchanger 35. That is, each second heat medium flow switching device 33 switches the passages of the heat medium that is to flow into the corresponding indoor unit 3 between the heat exchanger related to heat medium 25*a* and the heat exchanger related to heat medium 25*b* along with the corresponding first heat medium flow switching device 32.

Note that the second heat medium flow switching devices 33 are arranged so that the number thereof (four in this case) corresponds to the installed number of indoor units 3. Illustrated from the top of the drawing are the second heat medium flow switching device 33*a*, the second heat medium flow switching device 33*b*, the second heat medium flow switching device 33*c*, and the second heat medium flow switching device 33*d*, so as to correspond to the respective indoor units 3. Further, regarding the switching of the heat medium passage, not only a complete switching from one to the other but a partial switching from one to the other is also included.

The four heat medium flow control devices 34 (heat medium flow control devices 34*a* to 34*d*) each include, for example, a two-way valve capable of controlling the area of opening and controls the flow rate of the heat medium flowing in the corresponding piping 5. Each heat medium flow control device 34 is disposed on the outlet side of the heat medium passage of the corresponding use side heat exchanger 35 such that one way is connected to the use side heat exchanger 35 and the other way is connected to the first heat medium flow switching device 32. That is, each heat medium flow control device 34 controls the amount of heat medium flowing into the corresponding indoor unit 3 by the temperatures of the heat medium flowing into and flowing out of the indoor unit 3, and thus is capable of supplying the optimum amount of heat medium to the indoor unit 3 in relation to the indoor load.

Note that the heat medium flow control devices 34 are arranged so that the number thereof (four in this case) corresponds to the installed number of indoor units 3. Furthermore, illustrated from the top of the drawing are the heat medium flow control device 34*a*, the heat medium flow control device 34*b*, the heat medium flow control device 34*c*, and the heat medium flow control device 34*d* so as to correspond to the respective indoor units 3. Additionally, each of the heat medium flow control devices 34 may be disposed in the inlet side of the heat medium passage of the corresponding use side heat exchanger 35, that is, between the corresponding use side heat exchanger 35 and second heat medium flow switching device 33. Further, in the indoor units 3, during suspension, thermo-off, or the like, when no load is demanded, the heat medium flow control devices 34 may be totally closed and the supply of the heat medium to the indoor units 3 may be stopped.

Furthermore, the relay unit 2 is provided with two temperature sensors 40 (a temperature sensor 40*a* and a temperature sensor 40*b*). Information (temperature information) detected by these temperature sensors 40 are transmitted to a controller (not illustrated) that performs integrated control of the operation of the air-conditioning apparatus 100 such that the information is used to control, for example, the driving frequency of the compressor 10, the rotation speed of the air-sending device (not illustrated), switching of the first refrigerant flow switching device 11, the driving frequency of the pumps 31, switching by the second refrigerant flow switching devices 28, switching of passages of the heat medium, and the control of the flow rate of the heat medium of the indoor units 3.

Each of the two temperature sensors 40 detects the temperature of the heat medium flowing out of the corresponding heat exchanger related to heat medium 25, namely, the heat medium at an outlet of the corresponding heat exchanger related to heat medium 25 and may include, for example, a thermistor. The temperature sensor 40*a* is disposed in the piping 5 on the inlet side of the pump 31*a*. The temperature sensor 40*b* is disposed in the piping 5 on the inlet side of the pump 31*b*.

Further, the controller (not illustrated) includes, for example, a microcomputer and controls, for example, the driving frequency of the compressor 10, the rotation speed (including ON/OFF) of the air-sending device, switching of the first refrigerant flow switching device 11, driving of the pumps 31, the opening degree of each expansion device 26, opening and closing of each on-off device 29, switching of the second refrigerant flow switching devices 28, switching of the first heat medium flow switching devices 32, switching of the second heat medium flow switching devices 33, and the driving of each heat medium flow control device 34, on the basis of the information detected by each temperature sensor 40 and an instruction from a remote control to carry out the operation modes which will be described later. Note that the controller may be provided to each unit, or may be provided to the outdoor unit 1 or the relay unit 2.

The piping 5 in which the heat medium flows include the piping connected to the heat exchanger related to heat medium 25*a* and the piping connected to the heat exchanger related to heat medium 25*b*. Each piping 5 is branched (into four in this case) in accordance with the number of indoor units 3 connected to the relay unit 2. The piping 5 are connected with the first heat medium flow switching devices 32 and the second heat medium flow switching devices 33. Controlling the first heat medium flow switching devices 32 and the second heat medium flow switching devices 33 determines whether the heat medium flowing from the heat exchanger related to heat medium 25*a* is allowed to flow into the use side heat exchanger 35 or whether the heat medium flowing from the heat exchanger related to heat medium 25*b* is allowed to flow into the use side heat exchanger 35.

In the air-conditioning apparatus 100, the compressor 10, the first refrigerant flow switching device 11, the heat source side heat exchanger 12, the on-off device 27, the second refrigerant flow switching devices 28, a refrigerant passage of the heat exchanger related to heat medium 25, the expansion devices 26, and the accumulator 19 are connected through the refrigerant piping 4, thus forming the refrigerant circuit A. In addition, a heat medium passage of the heat exchanger related to heat medium 25*a*, the pumps 31, the first heat medium flow switching devices 32, the heat medium flow control devices 34, the use side heat exchangers 35, and the second heat medium flow switching devices 33 are connected through the piping 5, thus forming the heat medium circuit B. In other words, the plurality of use side heat exchangers 35 are connected in parallel to each of the heat exchangers related to heat medium 25, thus turning the heat medium circuit B into a multi-system.

Accordingly, in the air-conditioning apparatus 100, the outdoor unit 1 and the relay unit 2 are connected through the heat exchanger related to heat medium 25*a* and the heat exchanger related to heat medium 25*b* arranged in the relay unit 2. The relay unit 2 and each indoor unit 3 are connected through the heat exchanger related to heat medium 25*a* and the heat exchanger related to heat medium 25*b*. In other words, in the air-conditioning apparatus 100, the heat exchanger related to heat medium 25*a* and the heat exchanger related to heat medium 25*b* each exchange heat between the heat source side refrigerant circulating in the refrigerant circuit A and the heat medium circulating in the heat medium circuit B. By utilizing the above system configuration, the air-conditioning apparatus 100 is capable of achieving optimum cooling operation or heating operation in accordance with the indoor load.

Various operation modes executed by the air-conditioning apparatus 100 will be described below. The air-conditioning apparatus 100 allows each indoor unit 3, on the basis of an instruction from the indoor unit 3, to perform a cooling operation or a heating operation. Specifically, the air-conditioning apparatus 100 may allow all of the indoor units 3 to perform the same operation and also allow each of the indoor units 3 to perform different operations.

The operation modes carried out by the air-conditioning apparatus 100 includes the cooling only operation mode in which all of the operating indoor units 3 perform the cooling operation, the heating only operation mode in which all of the operating indoor units 3 perform the heating operation, the cooling main operation mode that is a cooling and heating mixed operation mode in which cooling load is larger, and the heating main operation mode that is a cooling and heating mixed operation mode in which heating load is larger. Additionally, the air-conditioning apparatus 100 is equipped with a first defrosting operation mode (a heat recovery defrosting operation mode) and a second defrosting operation mode (a bypass defrosting operation mode). The operation modes will be described below with respect to the flow of the heat source side refrigerant and that of the heat medium.

[Heating Only Operation Mode]

Figure 3:
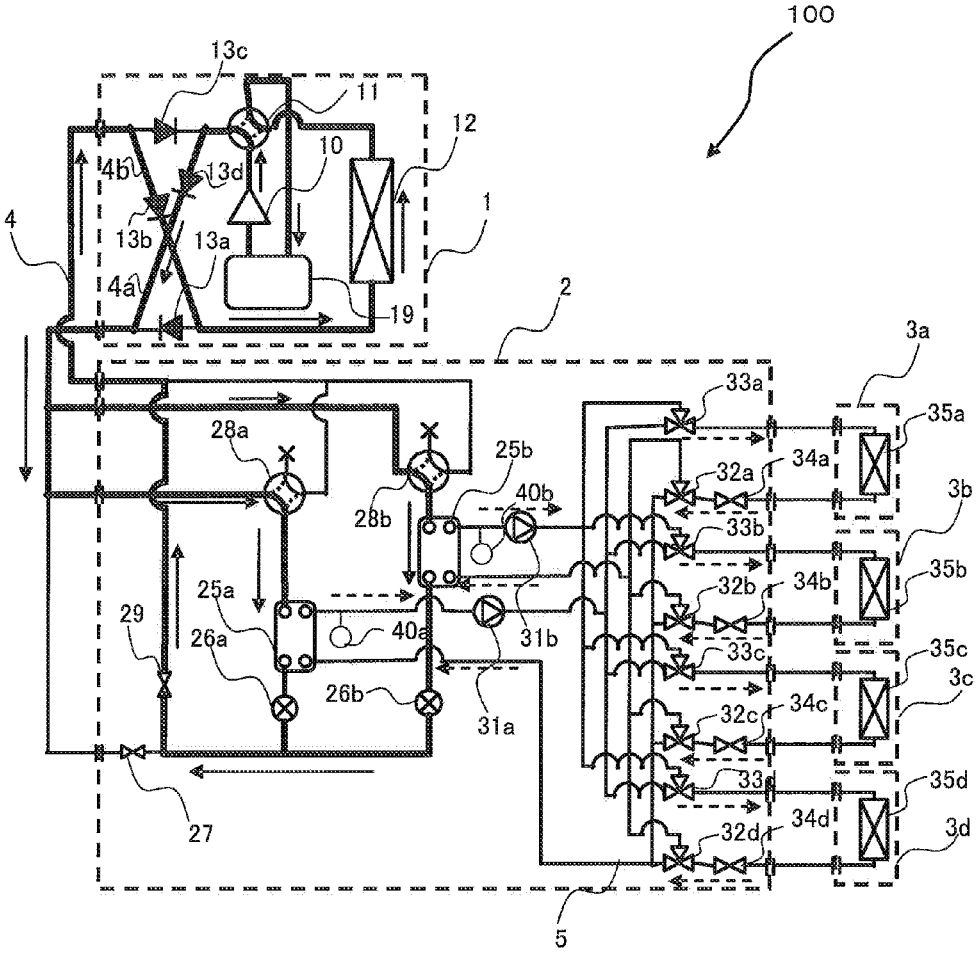
FIG. 3 is a refrigerant circuit diagram illustrating flows of refrigerants in a heating only operation mode of the air-conditioning apparatus according to Embodiment of the invention.

FIG. 3 is a refrigerant circuit diagram illustrating the flows of the refrigerants in the heating only operation mode of the air-conditioning apparatus 100. In FIG. 3, an exemplary case in which all of the indoor units 3 are driven will be described. Note that in FIG. 3, the flow of the heat source side refrigerant during the heating only operation mode is indicated by the refrigerant piping 4 with thick lines. In addition, the direction of flow of the heat source side refrigerant is indicated by solid-line arrows and the direction of flow of the heat medium is indicated by broken-line arrows in FIG. 3.

In the heating only operation mode illustrated in FIG. 3, the first refrigerant flow switching device 11 is switched such that the heat source side refrigerant discharged from the compressor 10 flows into the relay unit 2 without passing through the heat source side heat exchanger 12 in the outdoor unit 1.

In the relay unit 2, the second refrigerant flow switching device 28*a* and the second refrigerant flow switching device 28*b* are switched to the heating side, the pump 31*a* and the pump 31*b* are driven, and the heat medium flow control devices 34 are opened such that the heat medium circulates between each of the heat exchanger related to heat medium 25*a* and 25*b* and each of the use side heat exchangers 35. The opening degree of the expansion device 26*a* is controlled so that the degree of subcooling of the refrigerant in the outlet of the heat exchanger related to heat medium 25*a* becomes a predetermined target value. Similarly, the opening degree of the expansion device 26*b* is controlled so that the degree of subcooling of the refrigerant in the outlet of the heat exchanger related to heat medium 25*b* becomes a predetermined target value. Further, the on-off device 27 is closed and the on-off device 29 is opened.

Note that in order to supply the heat medium conveyed from both of the heat exchangers related to heat medium 25*a* and 25*b* to the heat medium flow control devices 34 and the indoor units 3, each of the second heat medium flow switching devices 33 is controlled such that the opening degree is at an intermediate degree or the opening degree is controlled in accordance with the temperature of the heat medium at the outlet of the heat exchangers related to heat medium 25*a* and 25*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant that has been discharged from the compressor 10 passes through the first refrigerant flow switching device 11, flows through the first connecting piping 4*a*, passes through the check valve 13*d*, and flows out of the outdoor unit 1. The high-temperature high-pressure gas refrigerant that has flowed out of the outdoor unit 1 passes through the refrigerant piping 4 and flows into the relay unit 2. The high-temperature high-pressure gas refrigerant that has flowed into the relay unit 2 is branched, passes through each of the second refrigerant flow switching device 28*a* and the second refrigerant flow switching device 28*b*, and flows into the corresponding one of the heat exchanger related to heat medium 25*a* and the heat exchanger related to heat medium 25*b*.

The high-temperature high-pressure gas refrigerant that has flowed into each of the heat exchanger related to heat medium 25*a* and the heat exchanger related to heat medium 25*b* is condensed and liquefied into a high-pressure liquid refrigerant while transferring heat to the heat medium circulating in the heat medium circuit B. The liquid refrigerant flowing out of the heat exchanger related to heat medium 25*a* and that flowing out of the heat exchanger related to heat medium 25*b* are expanded into a low-temperature low-pressure, two-phase refrigerant in the expansion device 26*a* and the expansion device 26*b*. This two-phase refrigerant passes through the on-off device 29, flows out of the relay unit 2, passes through the refrigerant piping 4, and again flows into the outdoor unit 1. The refrigerant that has flowed into the outdoor unit 1 flows through the second connecting piping 4*b*, passes through the check valve 13*b*, and flows into the heat source side heat exchanger 12 functioning as an evaporator.

Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

Next, the flow of the heat medium in the heat medium circuit B will be described.

In the heating only operation mode, both of the heat exchanger related to heat medium 25*a* and the heat exchanger related to heat medium 25*b* transfer heating energy of the heat source side refrigerant to the heat medium, and the pumps 31*a* and the pump 31*b* allow the high-temperature heat medium to flow through the piping 5. The heat medium, which has flowed out of each of the pump 31*a* and 31*b* while being pressurized, passes through the second heat medium flow switching device 33*a* to the second heat medium flow switching device 33*d* and flows into the use side heat exchanger 35*a* to the use side heat exchanger 35*d* after its flow rate has been adjusted in the heat medium flow control device 34*a* to the heat medium flow control device 34*d*. Then the high-temperature heat medium transfers heat to the indoor air in the use side heat exchanger 35*a* to the use side heat exchanger 35*d*, thus heats the indoor space 7.

Then, the heat medium flows out of the use side heat exchanger 35*a* to the use side heat exchanger 35*d* and is conveyed to the relay unit 2 from the indoor unit 3*a* to the indoor unit 3*d*. The heat medium that has been conveyed to the relay unit 2 flows into the heat medium flow control device 34*a* to the heat medium flow control device 34*d*. The heat medium that has flowed out of the heat medium flow control device 34*a* to the heat medium flow control device 34*d*, passes through the first heat medium flow switching device 32*a* to the first heat medium flow switching device 32*d*, flows into the heat exchanger related to heat medium 25*a* and the heat exchanger related to heat medium 25*b*, receives the quantity of heat amounting to the quantity of heat that had been supplied to the indoor space 7 through the indoor units 3, and is again sucked into the pump 31*a* and the pump 31*b*.

[Heating Main Operation Mode]

Figure 4:
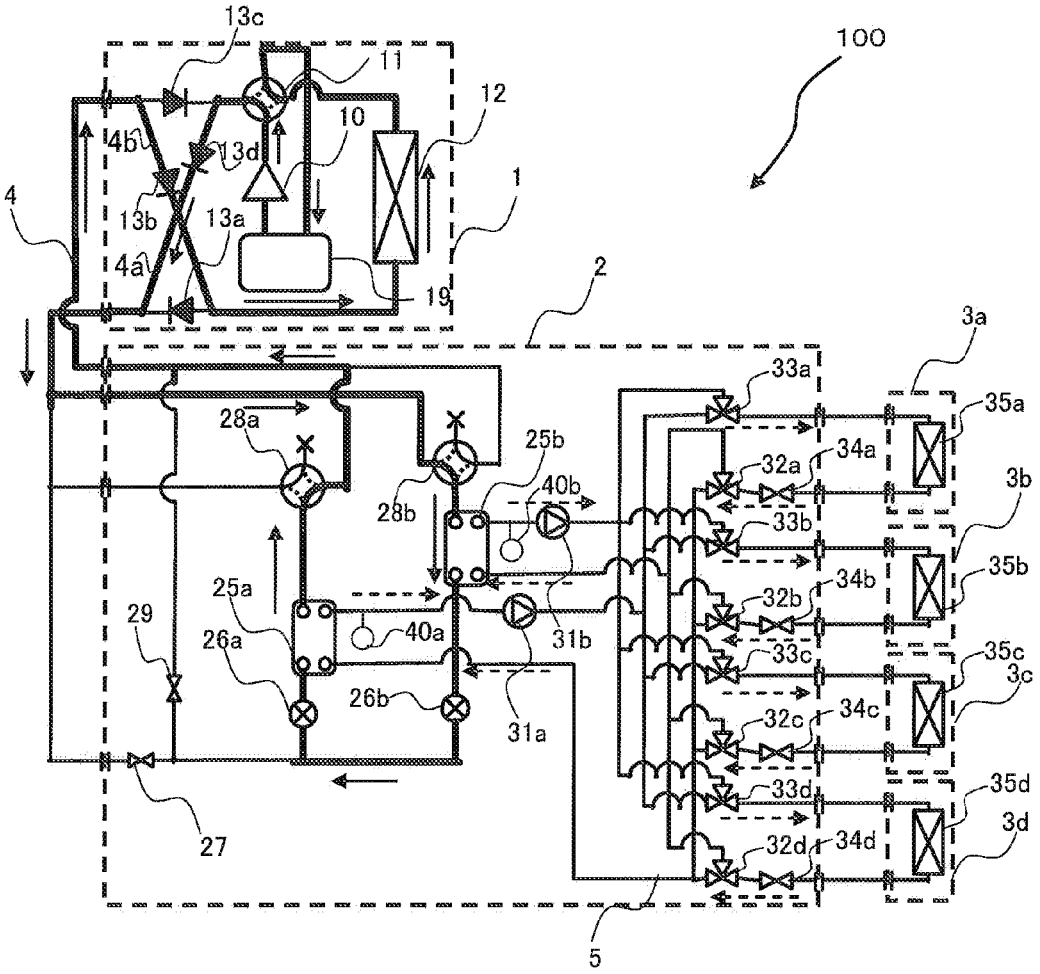
FIG. 4 is a refrigerant circuit diagram illustrating flows of refrigerants in a heating main operation mode of the air-conditioning apparatus according to Embodiment of the invention.

FIG. 4 is a refrigerant circuit diagram illustrating the flows of the refrigerants in the heating main operation mode of the air-conditioning apparatus 100. Note that in FIG. 4, the flow of the heat source side refrigerant during the heating main operation mode is indicated by the refrigerant piping 4 with thick lines. In addition, the direction of flow of the heat source side refrigerant is indicated by solid-line arrows and the direction of flow of the heat medium is indicated by broken-line arrows in FIG. 4.

In the heating main operation mode illustrated in FIG. 4, the first refrigerant flow switching device 11 is switched such that the heat source side refrigerant discharged from the compressor 10 flows into the relay unit 2 without passing through the heat source side heat exchanger 12 in the outdoor unit 1.

In the relay unit 2, the second refrigerant flow switching device 28*a* is switched to the cooling side and the second refrigerant flow switching device 28*b* is switched to the heating side, the pump 31*a* and the pump 31*b* are driven, the heat medium flow control devices 34 are opened, and the first heat medium flow switching devices 32 and the second heat medium flow switching devices 33 are each switched according to the operation mode carried out by the corresponding indoor unit 3. The opening degree of the expansion device 26*b* is controlled so that the degree of subcooling of the refrigerant in the outlet of the heat exchanger related to heat medium 25*b* becomes a predetermined target value. In addition, the expansion device 26*a* is fully opened, the on-off device 27 is closed, and the on-off device 29 is closed. Alternatively, the expansion device 26*b* may be fully opened and the expansion device 26*a* may control the degree of subcooling.

When the indoor unit 3 that is connected to the second heat medium flow switching device 33 is going to carry out the heating operation mode, the second heat medium flow switching device 33 is switched to the direction to which the heat exchanger related to heat medium 25*b* and the pump 31*b* are connected, and when the indoor unit 3 that is connected to the second heat medium flow switching device 33 is going to carry out the cooling operation mode, the second heat medium flow switching device 33 is switched to the direction to which the heat exchanger related to heat medium 25*a* and the pump 31*a* are connected. That is, depending on the operation mode of the indoor units 3, the heat medium that is supplied to the indoor units 3 can be switched to hot water or cold water.

When the indoor unit 3 that is connected to the first heat medium flow switching device 32 is carrying out the heating operation mode, the first heat medium flow switching device 32 is switched to the direction to which the heat exchanger related to heat medium 25*b* is connected, and when the indoor unit 3 that is connected to the first heat medium flow switching device 32 is carrying out the cooling operation mode, the first heat medium flow switching device 32 is switched to the direction to which the heat exchanger related to heat medium 25*a* is connected. As such, it will be possible for the heat medium that has been used in the heating operation mode to flow into the heat exchanger related to heat medium 25*b* that is functioning for a heating purpose and the heat medium that has been used in the cooling operation mode to flow into the heat exchanger related to heat medium 25*a* that is functioning for a cooling purpose.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant that has been discharged from the compressor 10 passes through the first refrigerant flow switching device 11, flows through the first connecting piping 4*a*, passes through the check valve 13*d*, and flows out of the outdoor unit 1. The high-temperature high-pressure gas refrigerant that has flowed out of the outdoor unit 1 passes through the refrigerant piping 4 and flows into the relay unit 2. The high-temperature high-pressure gas refrigerant that has flowed into the relay unit 2 passes through the second refrigerant flow switching device 28*b* and flows into the heat exchanger related to heat medium 25*b* functioning as a condenser.

The gas refrigerant that has flowed into the heat exchanger related to heat medium 25*b* is condensed and liquefied while transferring heat to the heat medium circulating in the heat medium circuit B, and turns into a liquid refrigerant. The liquid refrigerant flowing out of the heat exchanger related to heat medium 25*b* is expanded into a low-pressure two-phase refrigerant by the expansion device 26*b*. This low-pressure two-phase refrigerant flows through the expansion device 26*a* and into the heat exchanger related to heat medium 25*a* functioning as an evaporator. The low-pressure two-phase refrigerant that has flowed into the heat exchanger related to heat medium 25*a* removes heat from the heat medium circulating in the heat medium circuit B, is evaporated, and cools the heat medium. This low-pressure two-phase refrigerant flows out of the heat exchanger related to heat medium 25*a*, passes through the second refrigerant flow switching device 28*a*, flows out of the relay unit 2, passes through the refrigerant piping 4, and again flows into the outdoor unit 1.

The refrigerant that has flowed into the outdoor unit 1 passes through the check valve 13*b* and flows into the heat source side heat exchanger 12 functioning as an evaporator. Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

Next, the flow of the heat medium in the heat medium circuit B will be described.

In the heating main operation mode, the heat exchanger related to heat medium 25*b* transfers heating energy of the heat source side refrigerant to the heat medium, and the pump 31*b* allows the heated heat medium to flow through the piping 5. Furthermore, in the heating main operation mode, the heat exchanger related to heat medium 25*a* transfers cooling energy of the heat source side refrigerant to the heat medium, and the pump 31*a* allows the cooled heat medium to flow through the piping 5. The heat medium that has flowed out of the pump 31*a* and the pump 31*b* while being pressurized passes through the corresponding second heat medium flow switching device 33 that is connected to each indoor unit 3, and flows into the use side heat exchanger 35. The flow rate of the heat medium flowing into each use side heat exchanger 35 is controlled in the corresponding heat medium flow control device 34.

The heat medium exchanges heat with the indoor air in the use side heat exchanger 35 of the indoor unit 3, and thus heating or cooling of the indoor space 7 is carried out. The heat medium that has exchanged heat in the use side heat exchanger 35 flows through the piping 5 and flows into the relay unit 2 from the indoor unit 3. The heat medium that has flowed into the relay unit 2 flows through the heat medium flow control device 34 and flows into the first heat medium flow control device 32. The first heat medium flow switching device 32 makes the heat medium that has been used in the heating operation mode flow into the heat exchanger related to heat medium 25*b* that is functioning for a heating purpose and the heat medium that has been used in the cooling operation mode flow into the heat exchanger related to heat medium 25*a* that is functioning for a cooling purpose. Then, the heat medium exchanges heat with the heat source side refrigerant again, and is sucked into the pump 31*a* and the pump 31*b* again.

As described above, during the heating only operation mode or the heating main operation mode, the heat source side heat exchanger 12 in the outdoor unit 1 acts as an evaporator and exchanges heat with the outdoor air. Accordingly, when the temperature of the outdoor space 6 is low, the evaporating temperature of the heat source side heat exchanger 12 becomes low and moisture content in the outdoor air may form frost on the surface of the heat source side heat exchanger 12, and the heat exchange capacity may drop. Hence, in the air-conditioning apparatus 100, the evaporating temperature can be detected and when the detected evaporating temperature becomes excessively low, the air conditioning apparatus is made capable of carrying out defrosting operation modes (the first defrosting operation mode and the second defrosting operation mode, described below) that removes frost attached to the surface of the heat source side heat exchanger 12.

[First Defrosting Operation Mode]

Figure 5:
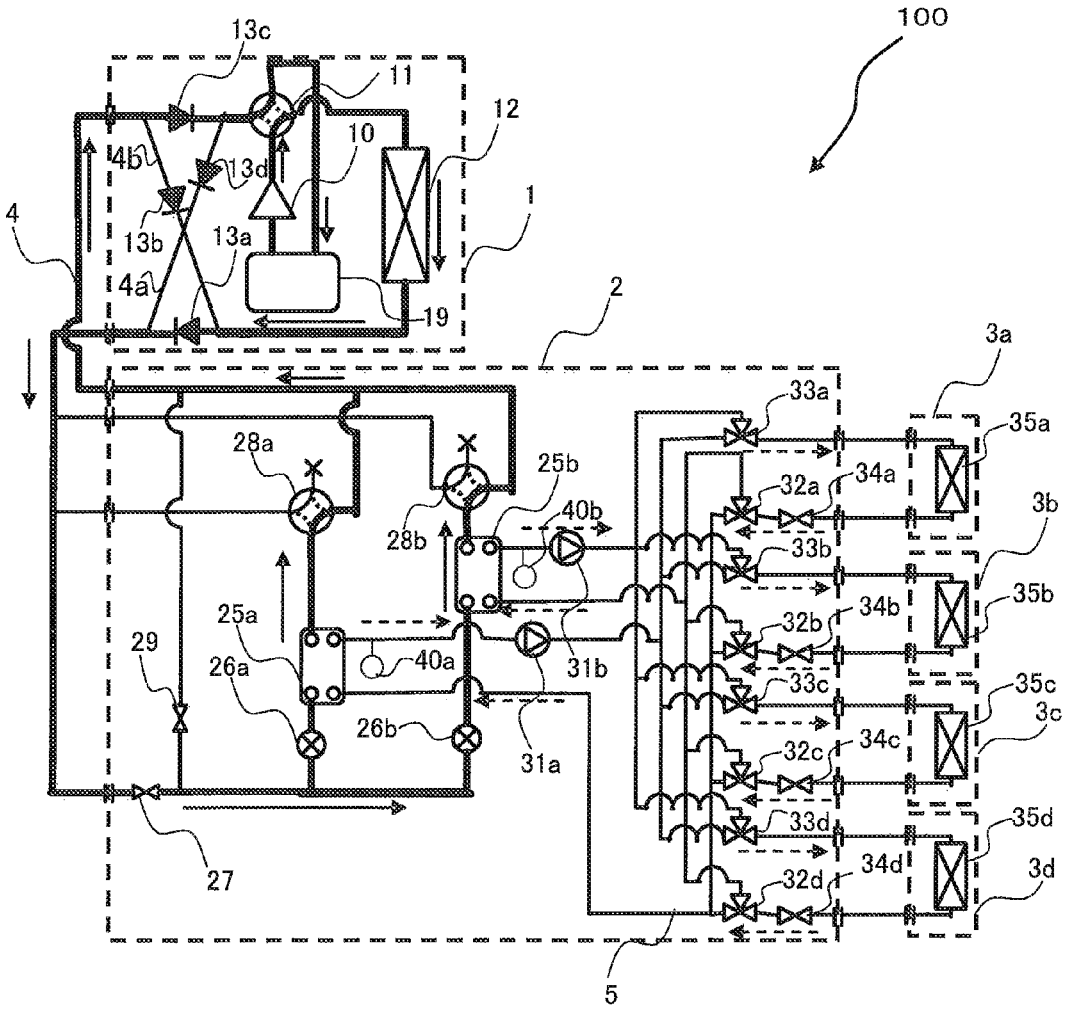
FIG. 5 is a refrigerant circuit diagram illustrating flows of refrigerants in a first defrosting operation mode carried out during the heating only operation mode of the air-conditioning apparatus according to Embodiment of the invention.

FIG. 5 is a refrigerant circuit diagram illustrating flows of refrigerants in the first defrosting operation mode carried out during the heating only operation mode of the air-conditioning apparatus 100. As described above, during the heating only operation mode, when the moisture content in the outdoor air forms frost on the heat source side heat exchanger 12 in the outdoor unit 1 and when the evaporating temperature drops, the air-conditioning apparatus 100 is made capable of carrying out an operation (the first defrosting operation mode) of removing frost attached to the surface of the heat source side heat exchanger 12. Note that in FIG. 5, the flow of the heat source side refrigerant during the first defrosting operation mode is indicated by the refrigerant piping 4 with thick lines. In addition, the direction of flow of the heat source side refrigerant is indicated by solid-line arrows and the direction of flow of the heat medium is indicated by broken-line arrows in FIG. 5.

In the first defrosting operation mode illustrated in FIG. 5, the first refrigerant flow switching device 11 is switched such that the heat source side refrigerant discharged from the compressor 10 flows directly into the heat source side heat exchanger 12 in the outdoor unit 1.

In the relay unit 2, the second refrigerant flow switching device 28*a* and the second refrigerant flow switching device 28*b* are switched to the cooling side, the pump 31*a* and the pump 31*b* are driven, and the heat medium flow control devices 34 are fully opened such that the heat medium circulates between each of the heat exchanger related to heat medium 25*a* and 25*b* and each of the use side heat exchangers 35. The expansion device 26*a* and the expansion device 26*b* are fully opened, the on-off device 27 is opened, and the on-off device 29 is closed.

Note that in order to supply the heat medium conveyed from both of the heat exchanger related to heat medium 25*a* and the heat exchanger related to heat medium 25*b* to the heat medium flow control devices 34 and the indoor units 3, each of the second heat medium flow switching devices 33 is controlled such that the opening degree is at an intermediate degree or the opening degree is controlled in accordance with the temperature of the heat medium at the outlet of the heat exchanger related to heat medium 25*a* and the heat exchanger related to heat medium 25*b*. Further, the opening degree control of the first heat medium flow switching devices 32 is the same as that of the second heat medium flow switching devices 33.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 and into the heat source side heat exchanger 12. Then the high-temperature high-pressure gas refrigerant condenses and liquefies while exchanging heat with the frost formed portion on the heat source side heat exchanger 12 and turns into a low-temperature high-pressure liquid refrigerant. At this time, the frost attached to the surface of the heat source side heat exchanger 12 is melted. The low-temperature high-pressure liquid refrigerant flowing out of the heat source side heat exchanger 12 passes through the check valve 13*a*, flows out of the outdoor unit 1, passes through the refrigerant piping 4, and flows into the relay unit 2.

The high-pressure liquid refrigerant that has flowed into the relay unit 2 is branched after passing through the on-off device 27, passes through the expansion device 26*a* and the expansion device 26*b*, and flows into the heat exchanger related to heat medium 25*a* and the heat exchanger related to heat medium 25*b*. The high-pressure liquid refrigerant becomes high in temperature by exchanging heat in the heat exchanger related to heat medium 25*a* and the heat exchanger related to heat medium 25*b* with the heat medium that had been used for heating until then. This refrigerant passes through the second refrigerant flow switching device 28*a* and the second refrigerant flow switching device 28*b* and then is conveyed to the outdoor unit 1 through the refrigerant piping 4. The high-temperature refrigerant that has been conveyed to the outdoor unit 1 passes through the check valve 13*c*, is guided into the accumulator 19 by passing through the first refrigerant flow switching device 11, and is returned to the compressor 10.

Next, the flow of the heat medium in the heat medium circuit B will be described.

In the first defrosting operation mode, both the heat exchanger related to heat medium 25*a* and the heat exchanger related to heat medium 25*b* transfer cooling energy of the heat source side refrigerant to the heat medium, and the pump 31*a* and the pump 31*b* allow the cooled heat medium to flow through the piping 5. The heat medium, which has flowed out of the pump 31*a* and the pump 31*b* while being pressurized, passes through the use side heat exchanger 35*a* to the use side heat exchanger 35*b* through the second heat medium flow switching device 33*a* to the second heat medium flow switching device 33*b*, and flows out of the indoor units 3.

The heat medium that has flowed out of the indoor units 3 flows into the heat exchanger related to heat medium 25*a* and heat exchanger related to heat medium 25*b* through the piping 5, heat medium flow control devices 34, and the first heat medium flow switching devices 32. The heat medium that has flowed into the heat exchanger related to heat medium 25*a* and the heat exchanger related to heat medium 25*b* exchanges heat with the heat source side refrigerant again, supplies quantity of heat to the heat source side refrigerant side, and is sucked into the pump 31*a* and the pump 31*b* again.

Figure 6:
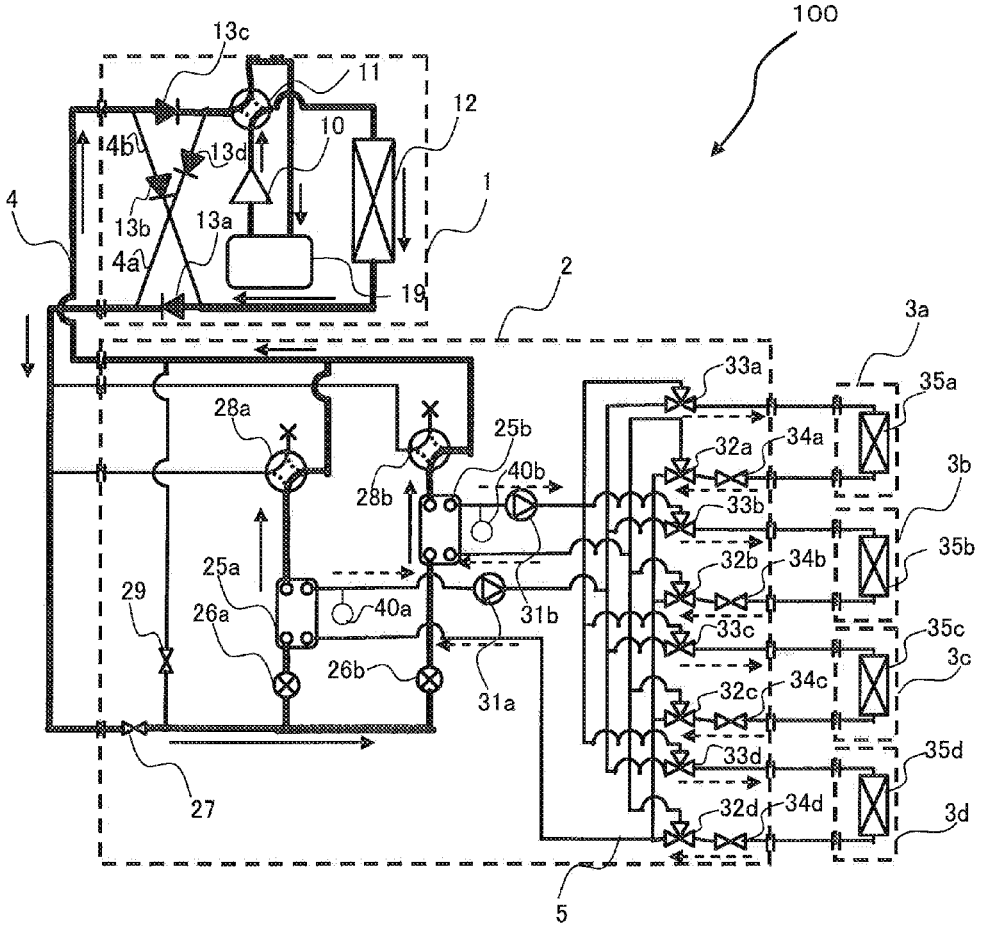
FIG. 6 is a refrigerant circuit diagram illustrating flows of refrigerants in the first defrosting operation mode carried out during the heating main operation mode of the air-conditioning apparatus according to Embodiment of the invention.

FIG. 6 is a refrigerant circuit diagram illustrating flows of refrigerants in the first defrosting operation mode carried out during the heating main operation mode of the air-conditioning apparatus 100. As described above, during the heating main operation mode, when the moisture content in the outdoor air forms frost on the heat source side heat exchanger 12 in the outdoor unit 1 and when the evaporating temperature drops, the air-conditioning apparatus 100 is made capable of carrying out the operation (the first defrosting operation mode) of removing frost attached to the surface of the heat source side heat exchanger. Note that in FIG. 6, the flow of the heat source side refrigerant during the first defrosting operation mode is indicated by the refrigerant piping 4 with thick lines. In addition, the direction of flow of the heat source side refrigerant is indicated by solid-line arrows and the direction of flow of the heat medium is indicated by broken-line arrows in FIG. 6.

In the first defrosting operation mode illustrated in FIG. 6, the first refrigerant flow switching device 11 is switched such that the heat source side refrigerant discharged from the compressor 10 flows directly into the heat source side heat exchanger 12 in the outdoor unit 1.

In the relay unit 2, the second refrigerant flow switching device 28*a* and the second refrigerant flow switching device 28*b* are switched to the cooling side, the pump 31*a* and the pump 31*b* are driven, and the opening degree of each heat medium flow control device 34 is controlled to control its flow rate based on the difference of the temperature immediately before the pump 31*a* and the outlet temperature of the connected indoor unit, such that the heat medium circulates between each of the heat exchanger related to heat medium 25*a* and 25*b* and each of the use side heat exchangers 35. The opening degree of the expansion device 26*a* is controlled such that the refrigerant in the outlet of the heat exchanger related to heat medium 25*a* is in a gaseous state, and the opening degree of the expansion device 26*b* is controlled so as to be virtually fully opened. Further, the on-off device 27 is opened and the on-off device 29 is closed.

Now, control of the second heat medium flow switching devices 33 and the first heat medium flow switching devices 32 will be described along with the flow of the heat medium.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then the high-temperature high-pressure gas refrigerant condenses and liquefies while exchanging heat with the frost formed portion on the heat source side heat exchanger 12 and turns into a low-temperature high-pressure liquid refrigerant. At this time, the frost attached to the surface of the heat source side heat exchanger 12 is melted. The low-temperature high-pressure liquid refrigerant flowing out of the heat source side heat exchanger 12 passes through the check valve 13*a*, flows out of the outdoor unit 1, passes through the refrigerant piping 4, and flows into the relay unit 2.

The high-pressure liquid refrigerant that has flowed into the relay unit 2 is branched after passing through the on-off device 27, passes through the expansion device 26*a* and the expansion device 26*b*, and flows into the heat exchanger related to heat medium 25*a* and the heat exchanger related to heat medium 25*b*. The high-pressure liquid refrigerant becomes high in temperature by exchanging heat in the heat exchanger related to heat medium 25*b* with the heat medium that had been used for heating until then. After passing through the second refrigerant flow switching device 28*b*, this refrigerant merges with the low-temperature refrigerant that has passed through the heat exchanger related to heat medium 25*a*, that has exchanged heat with the heat medium which had been use for cooling operation, and that has passed through the second refrigerant flow switching device 28*a*, and flows into the outdoor unit 1 through the refrigerant piping 4. The refrigerant that has been conveyed to the outdoor unit 1 passes through the check valve 13*c*, is guided into the accumulator 19 by passing through the first refrigerant flow switching device 11, and is returned to the compressor 10.

Next, the flow of the heat medium in the heat medium circuit B will be described.

In the first defrosting operation mode during the heating main operation mode, the heat exchanger related to heat medium 25*a* transfers cooling energy of the heat source side refrigerant to the heat medium, and the pump 31*a* allows the cooled heat medium to flow through the piping 5. Furthermore, in the first defrosting operation mode during the heating main operation mode, the heat medium that has been tuned low in temperature in the heat exchanger related to heat medium 25*b* is allowed to flow through the pipings 5 by the pump 31*b*. The heat medium that has flowed out of the pump 31*a* and the pump 31*b* while being pressurized passes through the corresponding second heat medium flow switching device 33 that is connected to each indoor unit 3, and flows into the use side heat exchanger 35. The flow rate of the heat medium flowing into each use side heat exchanger 35 is controlled in the corresponding heat medium flow control device 34.

At this time, when the indoor unit 3 that is connected to the second heat medium flow switching device 33 is going to carry out the heating operation mode, the second heat medium flow switching device 33 is switched to the direction to which the heat exchanger related to heat medium 25*b* and the pump 31*b* are connected, and when the indoor unit 3 that is connected to the second heat medium flow switching device 33 is going to carry out the cooling operation mode, the second heat medium flow switching device 33 is switched to the direction to which the heat exchanger related to heat medium 25*a* and the pump 31*a* are connected. That is, according to the operation mode of the indoor unit 3, switching is carried out such that cold water is continuously supplied to the indoor unit 3 or switching is carried out such that a heat medium that has exchanged heat with the low-temperature refrigerant in the heat exchanger related to heat medium 25*b* is newly supplied to the indoor unit 3 that has been supplied with hot water until then.

Incidentally, the heat medium that has been made to flow into the indoor unit 3 by the pump 31*a* continues the cooling operation by exchanging heat with the indoor air of the indoor space 7 in the use side heat exchanger 35 of the indoor unit 3 that has been carrying out cooling operation until then. The heat medium that has exchanged heat in the use side heat exchanger 35 flows out of the corresponding indoor unit 3 and flows into the relay unit 2. The heat medium that has flowed into the relay unit 2 is conveyed to the corresponding heat medium flow control device 34.

Then, the heat medium flows into the corresponding first heat medium flow switching device 32. The first heat medium flow switching device 32 is switched to the direction to which the heat exchanger related to heat medium 25*a* is connected. The heat medium that has been made to pass through the second heat medium flow switching device 33 and that has been made to flow into the indoor unit 3 connected with the piping 5 by the pump 31*b*, passes through the use side heat exchanger 35 of the indoor unit 3 that had been carrying out heating operation until then, passes through the corresponding piping 5, heat medium flow control device 34, and first heat medium flow switching device 32, and is conveyed to the relay unit 2.

At this time, the corresponding first heat medium flow switching device 32 is switched to the direction to which the heat exchanger related to heat medium 25*b* is connected. Accordingly, the heat medium that has been used in the heating operation mode can be made to flow into the heat exchanger related to heat medium 25*b* to which the refrigerant that has turned low in temperature by the defrosting operation in the outdoor unit 1 is conveyed, and the heat medium that has been used in the cooling operation mode can be made to flow into the heat exchanger related to heat medium 25*a* to which the refrigerant that has received heat as a cooling purpose refrigerant is conveyed. After each heat medium has exchanged heat with the refrigerant once more, the heat medium is sent to the heat medium conveying devices 31*a* and 31*b*.

Note that in the first defrosting operation mode during the heating only operation mode or the heating main operation mode, the indoor unit 3 that had been carrying out heating operation until then receives information that the outdoor unit 1 is under the defrosting operation mode and stops the fan (indoor fan, not shown). That is, supply of the use side medium (for example, air, water, and the like) to the use side heat exchanger 35 of the indoor unit 3 that had been carrying out heating operation until then is stopped. Further, the indoor unit 3 that had been carrying out cooling operation operates the fan (not shown). That is, supply of the use side medium to the use side heat exchanger 35 of the indoor unit 3 that has been carrying out cooling operation is continued.

However, if the room air temperature and the discharge air temperature of the indoor unit can be detected, there will be no problem in continuing the operation of the fan while the discharge air temperature of the indoor unit is not below the room air temperature. Further, by providing a heat medium temperature detection device (temperature sensor 40) in the outlet side passage of the heat exchanger related to heat medium 25, the operation of the fan may be continued while the heat medium temperature in the outlet of the heat exchanger related to heat medium 25 is not below the indoor air temperature.

While carrying out the first defrosting operation mode, by exchanging heat with the heat medium in the heat exchanger related to heat medium 25*a* and the heat exchanger related to heat medium 25*b* in the relay unit 2, the quantity of heat transferred to the heat source side refrigerant from the heat medium can be supplied to the heat source side heat exchanger 12 of the outdoor unit 1, and thus, the melting time of the formed frost can be shortened.

As described above, in the first defrosting operation mode, by exchanging heat with the heat medium in the heat exchanger related to heat medium 25*a* and the heat exchanger related to heat medium 25*b*, the quantity of heat that was to be conveyed to the indoor unit carrying out operation of the heating operation mode until then will be used to defrost the heat source side heat exchanger 12. Accordingly, if the quantity of heat conveyed to the indoor unit 3 that has been carrying out operation of the heating operation mode is excessively used, the temperature of the heat medium may be disadvantageously dropped and the air for heating in the indoor unit 3 may be cooled when returning from the defrosting operation mode.

Hence, in the air-conditioning apparatus 100, among the temperatures of the heat medium (the temperature of the heat medium detected by the temperature sensor 40*a* and the temperature of the heat medium detected by the temperature sensor 40*b*) conveyed to the indoor unit 3 that had been carrying out heating operation until then, from the temperatures of the last three control cycle (a temperature one cycle before denoted as T0, a temperature two control cycles before denoted as T1, and a temperature three control cycles before denoted as T2), the next anticipated heat medium temperature T is estimated as a preset temperature by the following equation (1).

$$T=(T0-T1)\cdot(T0-T1)/(T1-T2)+T0 \qquad \text{Equation (1)}$$

Then, a comparison is made between the temperature T estimated by the equation (1) and the highest indoor air temperature among the indoor air temperatures of the indoor unit 3 that had been carrying out the heating operation mode until then. Consequently, when the temperature T estimated by the equation (1) becomes below the highest indoor air temperature, the refrigerant passage is switched such that the heat medium and the refrigerant in the heat exchanger related to heat medium 25*a* and the heat exchanger related to heat medium 25*b* do not exchange heat. With the above, situation in which the heat medium temperature drops below the indoor air temperature can be averted (the second defrosting operation mode described below). Note that the refrigerant passage may be switched by simply comparing the heat medium temperature and the indoor air temperature so that the detection temperature T0 of the heat medium is higher than the highest indoor air temperature. Further, a temperature sensor detecting the temperature (the indoor air temperature) of the air made to pass through the use side heat exchanger 35 may be provided.

[Second Defrosting Operation Mode]

Figure 7:
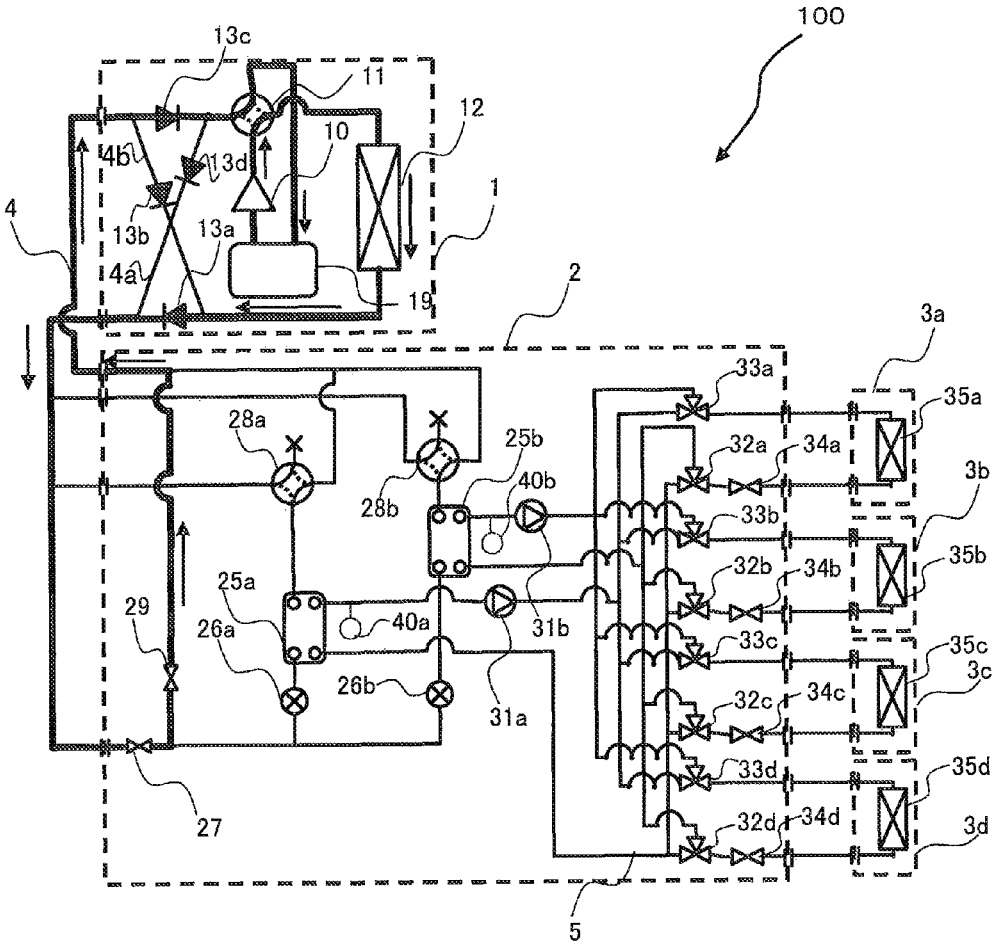
FIG. 7 is a refrigerant circuit diagram illustrating flows of refrigerants in a second defrosting operation mode carried out during the heating only operation mode of the air-conditioning apparatus according to Embodiment of the invention.

FIG. 7 is a refrigerant circuit diagram illustrating flows of refrigerants in the second defrosting operation mode carried out during the heating only operation mode of the air-conditioning apparatus 100. As described above, during the heating only operation mode, when the moisture content in the outdoor air forms frost on the heat source side heat exchanger 12 in the outdoor unit 1 and when the evaporating temperature drops, the air-conditioning apparatus 100 is made capable of carrying out removal of the frost attached to the surface of the heat source side heat exchanger 12 as well as carrying out an operation (the second defrosting operation mode) preventing the heat medium temperature to drop below the highest indoor air temperature. Note that in FIG. 7, the flow of the heat source side refrigerant during the second defrosting operation mode is indicated by the refrigerant piping 4 with thick lines. In addition, the direction of flow of the heat source side refrigerant is indicated by solid-line arrows and the direction of flow of the heat medium is indicated by broken-line arrows in FIG. 7.

In the first defrosting operation mode illustrated in FIG. 7, the first refrigerant flow switching device 11 is switched such that the heat source side refrigerant discharged from the compressor 10 flows directly into the heat source side heat exchanger 12 in the outdoor unit 1.

In the relay unit 2, both the second refrigerant flow switching device 28*a* and the second refrigerant flow switching device 28*b* are kept as they are, that is, in the state during the first defrosting operation mode, and the pump 31*a* and pump 31*b* are stopped such that no heat medium flows therein. The expansion device 26*a* and the expansion device 26*b* are totally closed, the on-off device 27 is opened, and the on-off device 29 is opened. That is, the heat source side does not convey any refrigerant to the heat exchanger related to heat medium 25*a* and heat exchanger related to heat medium 25*b*.

Note that the second heat medium flow switching devices 33 are controlled to an intermediate opening degree. Further, the opening degree control of the first heat medium flow switching devices 32 is the same as that of the second heat medium flow switching devices 33. Furthermore, the heat medium flow control devices 34 are totally closed.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then the high-temperature high-pressure gas refrigerant condenses and liquefies while exchanging heat with the frost formed portion on the heat source side heat exchanger 12 and turns into a low-temperature high-pressure liquid refrigerant. At this time, the frost attached to the surface of the heat source side heat exchanger 12 is melted. The low-temperature high-pressure liquid refrigerant flowing out of the heat source side heat exchanger 12 passes through the check valve 13*a*, flows out of the outdoor unit 1, passes through the refrigerant piping 4, and flows into the relay unit 2.

The high-pressure liquid refrigerant that has flowed into the relay unit 2 passes through the on-off device 29 after passing through the on-off device 27. The refrigerant that has passed through the on-off device 29 is directly conveyed out of the relay unit 2 and flows into the outdoor unit 1 through the refrigerant piping 4. The high-temperature refrigerant that has been conveyed to the outdoor unit 1 passes through the check valve 13*c*, is guided into the accumulator 19 by passing through the first refrigerant flow switching device 11, and is returned to the compressor 10.

Next, the flow of the heat medium in the heat medium circuit B will be described.

In the first defrosting operation mode, both the heat exchanger related to heat medium 25*a* and the heat exchanger related to heat medium 25*b* transfer cooling energy of the heat source side refrigerant to the heat medium, the cooled heat medium is made to flow through the piping 5 by the pump 31*a* and the pump 31*b*, and the temperature of the heat medium is virtually the same to the temperature of the indoor air temperature. Accordingly, the heat medium circuit B is in stop mode.

Figure 8:
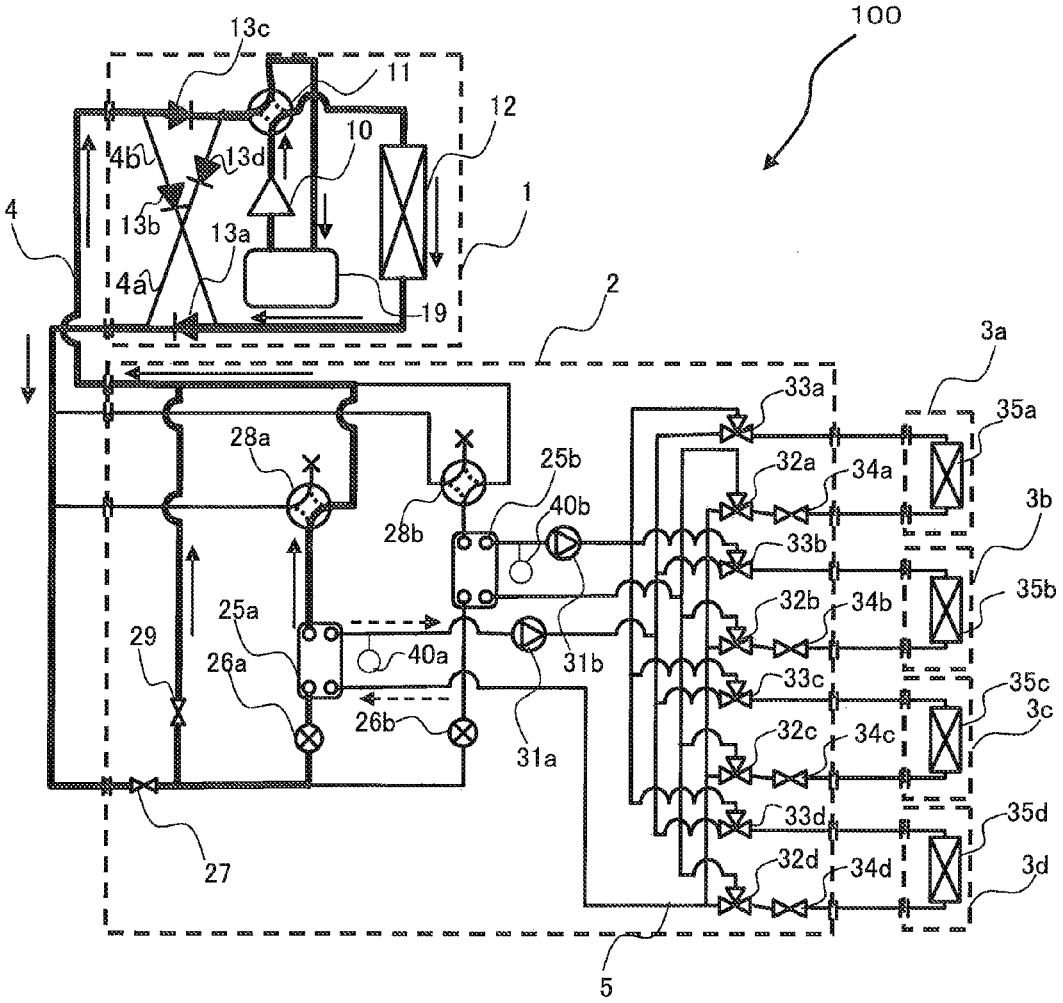
FIG. 8 is a refrigerant circuit diagram illustrating flows of refrigerants in the second defrosting operation mode carried out during the heating main operation mode of the air-conditioning apparatus according to Embodiment of the invention.

FIG. 8 is a refrigerant circuit diagram illustrating flows of refrigerants in the second defrosting operation mode carried out during the heating main operation mode of the air-conditioning apparatus 100. As described above, during the heating main operation mode, when the moisture content in the outdoor air forms frost on the heat source side heat exchanger 12 in the outdoor unit 1 and when the evaporating temperature drops, the air-conditioning apparatus 100 is made capable of carrying out removal of the frost attached to the surface of the heat source side heat exchanger 12 as well as carrying out an operation (the second defrosting operation mode) preventing the heat medium temperature to drop below the highest indoor air temperature. Note that in FIG. 8, the flow of the heat source side refrigerant during the second defrosting operation mode is indicated by the refrigerant piping 4 with thick lines. In addition, the direction of flow of the heat source side refrigerant is indicated by solid-line arrows and the direction of flow of the heat medium is indicated by broken-line arrows in FIG. 8.

In the second defrosting operation mode illustrated in FIG. 8, the first refrigerant flow switching device 11 is switched such that the heat source side refrigerant discharged from the compressor 10 flows directly into the heat source side heat exchanger 12 in the outdoor unit 1.

In the relay unit 2, both the second refrigerant flow switching device 28*a* and the second refrigerant flow switching device 28*b* are kept in the state until then, that is, the state during the first defrosting operation mode, the pump 31*a* is driven, the pump 31*b* is stopped, and the opening degree of each heat medium flow control device 34 is controlled to control its flow rate based on the difference of the temperature immediately before the pump 31*a* and the outlet temperature of the connected indoor unit, such that the heat medium circulates between the heat exchanger related to heat medium 25*a* and the use side heat exchangers 35. The opening degree of the expansion device 26*a* is controlled such that the refrigerant in the outlet of the heat exchanger related to heat medium 25*a* is in a gaseous state, and the opening degree of the expansion device 26*b* is controlled so as to be virtually totally closed. Further, the on-off device 27 is opened and the on-off device 29 is opened.

Now, control of the second heat medium flow switching devices 33 and the first heat medium flow switching devices 32 will be described along with the flow of the heat medium.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then the high-temperature high-pressure gas refrigerant condenses and liquefies while exchanging heat with the frost formed portion on the heat source side heat exchanger 12 and turns into a low-temperature high-pressure liquid refrigerant. At this time, the frost attached to the surface of the heat source side heat exchanger 12 is melted. The low-temperature high-pressure liquid refrigerant flowing out of the heat source side heat exchanger 12 passes through the check valve 13*a*, flows out of the outdoor unit 1, passes through the refrigerant piping 4, and flows into the relay unit 2.

The high-pressure liquid refrigerant that has flowed into the relay unit 2 passes through the on-off device 27 and is branched so that a portion flows into the on-off device 29 and the other portion flows into the on-off device 26*a*. Accordingly, while heat is exchanged with the heat medium in the heat exchanger related to heat medium 25*a*, no heat is exchanged with the heat medium in the heat exchanger related to heat medium 25*b*. The refrigerant that has passed through the on-off device 29 merges with the refrigerant that has exchanged heat in the heat exchanger related to heat medium 25*a* and that has passed through the second refrigerant flow switching device 28*a*, is conveyed out of the relay unit 2, and flows into the outdoor unit 1 through the refrigerant piping 4. The refrigerant that has been conveyed to the outdoor unit 1 passes through the check valve 13*c*, is guided into the accumulator 19 by passing through the first refrigerant flow switching device 11, and is returned to the compressor 10.

Next, the flow of the heat medium in the heat medium circuit B will be described.

In the second defrosting operation mode during the heating main operation mode, the heat exchanger related to heat medium 25*a* transfers cooling energy of the heat source side refrigerant to the heat medium, and the pump 31*a* allows the cooled heat medium to flow through the piping 5. The heat medium that has flowed out of the pump 31*a* while being pressurized passes through the second heat medium flow switching device 33 that is connected to each indoor unit 3, and flows into the corresponding use side heat exchanger 35. The flow rate of the heat medium flowing into each use side heat exchanger 35 is controlled in the corresponding heat medium flow control device 34.

At this time, when the indoor unit 3 that is connected to the second heat medium flow switching device 33 is going to carry out the heating operation mode, the second heat medium flow switching device 33 is switched to the direction to which the heat exchanger related to heat medium 25*b* and the pump 31*b* are connected, and when the indoor unit 3 that is connected to the second heat medium flow switching device 33 is going to carry out the cooling operation mode, the second heat medium flow switching device 33 is switched to the direction to which the heat exchanger related to heat medium 25*a* and the pump 31*a* are connected. The heat medium that has been made to flow into the indoor unit 3 by the pump 31*a* continues the cooling operation by exchanging heat with the indoor air of the indoor space 7 in the use side heat exchanger 35 of the indoor unit 3 that has been carrying out cooling operation until then.

The heat medium that has exchanged heat in the use side heat exchanger 35 flows out of the corresponding indoor unit 3 and flows into the relay unit 2. The heat medium that has flowed into the relay unit 2 is conveyed to the corresponding heat medium flow control device 34.

Then, the heat medium flows into the corresponding first heat medium flow switching device 32. The first heat medium flow switching device 32 is switched to the direction to which the heat exchanger related to heat medium 25*a* is connected.

At this time, the first heat medium flow switching device 32 is switched to the direction to which the heat exchanger related to heat medium 25*a* is connected. On the other hand, the pump 31*b* is suspended and does not convey any heat medium. Note that the second heat medium flow switching device 33 that is connected to the indoor unit 3 that had been carrying out the heating operation mode is switched to the direction in which the pump 31*b* is connected. Further, the heat medium flow control device 34 that is connected to the indoor unit 3 that had been carrying out the heating operation mode is totally closed, and the corresponding first heat medium flow switching device 32 is set to the same opening degree as that of the second heat medium flow switching device 33.

Furthermore, the temperature of any portion in the passage between the expansion devices 26 to the outlet side of the heat exchanger related to heat mediums 25 is detected, and if this temperature is higher than a predetermined set temperature, the heat recovery defrosting operation mode is carried out, and if lower than the predetermined set temperature (for example, 0 degrees) or the estimated temperature at the next clock time is estimated to become lower than the preset temperature, the compressor reduces its rotation speed. With the above, the refrigerant temperature can be increased and freezing of the heat medium can be prevented. Alternatively, when the temperature is lower than a predetermined set temperature, the refrigerant circuit may be switched so that the bypass defrosting operation mode is carried out, thus, sure prevention of freezing of the heat medium is achieved and a safe device is obtained.

As described above, the air-conditioning apparatus 100 exchanges heat between the heat source side refrigerant and the heat medium through the relay unit 2 without circulating the refrigerant directly to the indoor space 7 where the indoor units 3 are disposed. Cooling operation and heating operation is carried out by conveying the heat medium to the indoor units 3, and with this, it is possible to avert refrigerant leaking into the indoor space 7. Further, in the air-conditioning apparatus 100, since the refrigerant is conveyed from the outdoor unit 1 to the relay unit 2, it will be possible to dispose the relay unit 2 in an appropriate location, thus allowing the conveying distance of the heat medium to be short, reduction of power of the pumps 31, and achievement of further energy saving.

Furthermore, in the air-conditioning apparatus 100, in the defrost operation mode carried out during execution of the heating operation when the outdoor air temperature is low, the refrigerant that has exchanged heat during the defrosting and that has turned low in temperature is made to exchange heat with the heat medium that had been conveyed to the indoor unit 3 during the heating operation, and is conveyed to the outdoor unit 1. Accordingly, the heat capacity of the heat medium can be used for defrosting, and thus, the defrosting operation time can be shortened.

Additionally, in the air-conditioning apparatus 100, when exchanging heat between the heat medium and the heat source side refrigerant, a comparison is made between the heat medium temperature and the highest indoor air temperature among the detected indoor air temperature of the indoor unit 3 that had been carrying out the heating operation mode until then. If the heat medium temperature is estimated to be lower than the highest detected indoor air temperature, by switching the refrigerant side passage, heat exchange between the refrigerant and the heat medium can be prevented and further prevent the heat medium temperature from dropping.

While Embodiment has been described with respect to the case in which the air-conditioning apparatus 100 includes the accumulator 19, the accumulator 19 may be omitted. Typically, a heat source side heat exchanger 12 and a use side heat exchanger 35 are provided with an air-sending device in which a current of air often facilitates condensation or evaporation. The structure is not limited to this case. For example, a heat exchanger, such as a panel heater, using radiation can be used as the use side heat exchanger 35 and a water-cooled heat exchanger that transfers heat using water or antifreeze can be used as the heat source side heat exchanger 12. In other words, regarding the heat source side heat exchanger 12 and the use side heat exchanger 35, any type of use side medium can be used as long as their structures that can transfer heat or receive heat.

Embodiment has been described in which the number of use side heat exchanges 35 is four. As a matter of course, the arrangement is not limited to this case. Furthermore, Description has been made illustrating a case in which there are two heat exchangers related to heat medium 25, namely, heat exchanger related to heat medium 25*a* and heat exchanger related to heat medium 25*b*. As a matter of course, the arrangement is not limited to this case, and as long as it is configured so that cooling and/or heating of the heat medium can be carried out, the number may be any number. Furthermore, each of the number of pumps 31*a* and that of pumps 31*b* is not limited to one. A plurality of pumps having a small capacity may be connected in parallel.

REFERENCE SIGNS LIST

1 outdoor unit; 2 relay unit; 3 indoor unit; 3*a* indoor unit; 3*b* indoor unit; 3*c* indoor unit; 3*d* indoor unit; 4 refrigerant piping; 4*a* first connecting piping; 4*b* second connecting piping; 5 piping; 6 outdoor space; 7 indoor space; 8 space; 9 structure; 10 compressor; 11 first refrigerant flow switching device; 12 heat source side heat exchanger; 13*a* check valve; 13*b* check valve; 13*c* check valve; 13*d* check valve; 17 on-off device; 19 accumulator; 25 heat exchanger related to heat medium; 25*a* heat exchanger related to heat medium; 25*b* heat exchanger related to heat medium; 26 expansion device; 26*a* expansion device; 26*b* expansion device; 27 on-off device; 28 second refrigerant flow switching device; 28*a* second refrigerant flow switching device; 28*b* second refrigerant flow switching device; 29 on-off device; 31 pump; 31*a* pump; 31*b* pump; 32 first heat medium flow switching device; 32*a* first heat medium flow switching device; 32*b* first heat medium flow switching device; 32*c* first heat medium flow switching device; 32*d* first heat medium flow switching device; 33 second heat medium flow switching device; 33*a* second heat medium flow switching device; 33*b* second heat medium flow switching device; 33*c* second heat medium flow switching device; 33*d* second heat medium flow switching device; 34 heat medium flow control device; 34*a* heat medium flow control device; 34*b* heat medium flow control device; 34*c* heat medium flow control device; 34*d* heat medium flow control device; 35 use side heat exchanger; 35*a* use side heat exchanger; 35*b* use side heat exchanger; 35*c* use side heat exchanger; 35*d* use side heat exchanger; 40 temperature sensor; 40*a* temperature sensor; 40*b* temperature sensor; 100 air-conditioning apparatus; A refrigerant circuit; and B heat medium circuit.

The invention claimed is:

1. An air-conditioning apparatus, comprising:

a refrigerant circuit including, connected by piping, at least a compressor, a heat source side heat exchanger, each refrigerant passage of two or more heat exchangers related to heat medium that each exchange heat with the refrigerant and an expansion device arranged in each refrigerant passage of the two or more heat exchangers related to heat medium, the refrigerant circuit circulating a heat source side refrigerant; and a heat medium circuit including at least two heat medium loops, each including connected by piping, at least a heat medium passage of one of the two or more heat exchangers related to heat medium, a pump, and a use side heat exchanger, the at least two heat medium loops configured to circulate a heat medium, wherein at least a bypass piping is provided in the refrigerant circuit, which bypasses the two or more heat exchangers related to heat medium and returns the heat source side refrigerant to the compressor, a controller which includes a temperature sensor arranged in an outlet of each of the heat exchangers related to a heat medium to detect a heat medium temperature, and configured to carry out a first defrosting operation or second defrosting operation based on the detected temperatures, the controller being configured to operate the air-conditioning apparatus sequentially in:

a heating operation in which after the refrigerant discharged from the compressor has flowed into at least one of the heat exchangers related to heat medium and has exchanged heat with the heat medium, the refrigerant receives heat in the heat source side heat exchanger and the heat medium that has been heated in the heat exchanger(s) related to heat medium flows into a use side heat exchanger having a heating requirement and transfers heat;

a first defrosting operation that is switched from the heating operation when an evaporating temperature in the heat source side heat exchanger becomes equal to or lower than a predetermined temperature, in which after the refrigerant discharged from the compressor has transferred heat in the heat source side heat exchanger, the refrigerant flows into the at least one of the heat exchangers related to heat medium that had heated the heat medium during the heating operation, receives heat from the heat medium, and is sucked into the compressor, and the heat medium that had been cooled in the heat exchanger related to heat medium flows into a use side heat exchanger having a heating requirement; and a second defrosting operation that is switched from the first defrosting operation when a heat medium temperature flowing into the use side heat exchanger having the heating requirement is equal to or lower than a predetermined temperature, in which after the refrigerant discharged from the compressor transfers heat in the heat source side heat exchanger, the refrigerant bypasses the heat exchanger(s) related to heat medium that is conveying the heat medium to the use side heat exchanger having a heating requirement and is sucked into the compressor, wherein the controller includes a temperature sensor arranged in an outlet of each of the heat exchangers related to heat medium to detect a heat medium temperature and the controller is configured to carry out the first defrosting operation or the second defrosting operation based on the detected temperatures.

2. The air-conditioning apparatus of claim 1, wherein the controller is configured to carry out the first defrosting operation when the heat medium temperature in the outlets of the heat exchangers related to heat medium is equal to or higher than a first set temperature and to carry out the second defrosting operation when the heat medium temperature in the outlets of the heat exchangers related to heat medium are lower than the first set temperature.

3. The air-conditioning apparatus of claim 2, wherein the first set temperature is a highest temperature of temperatures of each of a use side heat transfer medium supplied to the use side heat exchangers.

4. The air-conditioning apparatus of claim 1, comprising:

a temperature sensor arranged in each refrigerant passage in any portion in the passage between the expansion device and the outlet side of each of the heat exchangers related to heat medium to detect a refrigerant temperature;

wherein the controller is configured to reduce a compressor rotation speed or carry out the second defrosting operation when the detected refrigerant temperature of any portion in the passage between the expansion device to the outlet side of each of the heat exchangers related to heat medium is lower than a second set temperature or when estimated to be lower.

5. The air-conditioning apparatus of claim 1, wherein the controller is configured to carry out the first defrosting operation during a heating only operation, in which all of the heat exchangers related to heat medium heat the heat medium, by melting frost attached to the heat source side heat exchanger by fully opening the expansion device and by having the heat source side refrigerant receive heat from the heat medium flowing in all of the heat exchangers related to heat medium.

6. The air-conditioning apparatus of claim 5, wherein the controller is configured to carry out the second defrosting operation by totally closing the expansion device and passing the entire heat source side refrigerant that is flowing in all of the heat exchangers related to heat medium through the bypass piping.

7. The air-conditioning apparatus of claim 1, wherein the controller is configured to carry out the first defrosting operation during a heating main operation, in which one or some of the heat exchangers related to heat medium heat the heat medium and one or some of the remaining heat exchangers related to heat medium cool the heat medium, by melting frost attached to the heat source side heat exchanger by fully opening the expansion device corresponding to the heat exchangers related to heat medium that had heated the heat medium, by continuing the cooling in the heat exchangers related to heat medium that had been cooling the heat medium, and by having the heat source side refrigerant receive heat from the heat medium flowing in the heat exchanger related to heat medium that had heated the heat medium.

8. The air-conditioning apparatus of claim 7, wherein the controller is configured to carry out the second defrosting operation by totally closing the expansion device corresponding to the heat exchangers related to heat medium that had heated the heat medium, by continuing the cooling in the heat exchangers related to heat medium that had been cooling the heat medium, and by passing a portion of the heat source side refrigerant through the bypass piping.

9. The air-conditioning apparatus of claim 1, wherein the controller is configured to, in the first defrosting operation, stop supplying the use side medium to the use side heat exchanger that had been carrying out heating operation and continuing supplying of the use side medium to a use side heat exchanger that is carrying out a cooling operation.

10. The air-conditioning apparatus of claim 1, wherein a housing accommodating the compressor and the outdoor heat exchanger; a housing accommodating the heat exchanger related to heat medium, the expansion device, and the pump; and a housing accommodating the use side heat exchanger are each a different housing.

* * * * *